US006322044B1

(12) United States Patent
Vangedal-Nielsen

(10) Patent No.: US 6,322,044 B1
(45) Date of Patent: Nov. 27, 2001

(54) ICE CUBE BAG AND METHOD OF PRODUCING ICE CUBE BAGS

(75) Inventor: Erling Vangedal-Nielsen, Vedbæk (DK)

(73) Assignee: Unigreen International A/S, Vedbaek (DK)

( * ) Notice: Subject to any disclaimer, the term of this patent is extended or adjusted under 35 U.S.C. 154(b) by 0 days.

(21) Appl. No.: 09/590,477

(22) Filed: Jun. 8, 2000

Related U.S. Application Data

(63) Continuation of application No. PCT/DK98/00539, filed on Dec. 9, 1998.

(51) Int. Cl.[7] ..... F25C 1/24; B65D 30/22

(52) U.S. Cl. ..... 249/61; 249/110; 249/119; 383/38; 383/107; 383/108; 383/901

(58) Field of Search ..... 249/61, 110, 119; 383/38, 107, 108, 200, 901; D15/90

(56) References Cited

U.S. PATENT DOCUMENTS

| | | | | |
|---|---|---|---|---|
| Re. 31,890 | | 5/1985 | Vangedal-Nielsen | 249/61 |
| D. 288,409 | * | 2/1987 | Mikkelsen | D9/305 |
| 3,189,252 | | 6/1965 | Miller | 229/62.5 |
| 3,207,420 | | 9/1965 | Navarrete-Kindelan | 229/56 |
| 3,263,903 | | 8/1966 | Waller et al. | 229/62.5 |
| 3,282,412 | | 11/1966 | Corella et al. | 206/47 |
| 4,587,810 | * | 5/1986 | Fletcher | 249/61 |
| 4,718,556 | * | 1/1988 | Hildebrandt | 383/200 |
| 5,474,818 | * | 12/1995 | Ulrich et al. | 383/107 |
| 5,527,012 | * | 6/1996 | Vinkel et al. | 249/61 |
| 5,846,446 | * | 12/1998 | Jackson | 249/119 |

FOREIGN PATENT DOCUMENTS

| | | |
|---|---|---|
| 0129072 | 12/1984 | (EP) . |
| 87/01183 | 2/1987 | (WO) . |
| 87/06558 | 11/1987 | (WO) . |
| 92/15491 | 9/1992 | (WO) . |
| 97/35708 | 10/1997 | (WO) . |

* cited by examiner

*Primary Examiner*—James P. Mackey
(74) *Attorney, Agent, or Firm*—Klein & Szekeres, LLP

(57) ABSTRACT

An ice cube bag comprises two sheet-shaped foil layers (12, 14; 12', 14') defining an outer periphery. A peripheral joint (20, 21, 21*a*, 21*b*) extends along the major part of the outer periphery of the foil layers, with the exception of a peripheral area constituting an inlet aperture of the bag (10). Their peripheral joint joins the foil layers together defining an inner chamber which is divided into several ice cube compartments defined by separate joints (22, 23, 24, 25, 29) of the foil layers. An inlet channel extends from the inlet aperture to the inner chamber of the bag hereby allowing admission from the surroundings to the inner chamber of the bag through the inlet channel. Each of the separate joints (22, 23, 24, 25, 29) is constituted by a number of individual joints (22, 23, 24, 25, 29), each of these individual joints (22, 23, 24,25, 29) establishing a connection between the two sheet-shaped foil layers (12, 14'12', 14') with such a joint strength and with such a limited area extension that the individual joint is not broken when the foil layers (12, 14; 12', 14') are exposed to a separation force, but provides a tearing apart or perforation (44) in one of the foil layers (12, 14, 12', 14') along the periphery of the individual joints. Hereby an ice cube bag is obtained which is easy to open by tearing it apart.

27 Claims, 19 Drawing Sheets

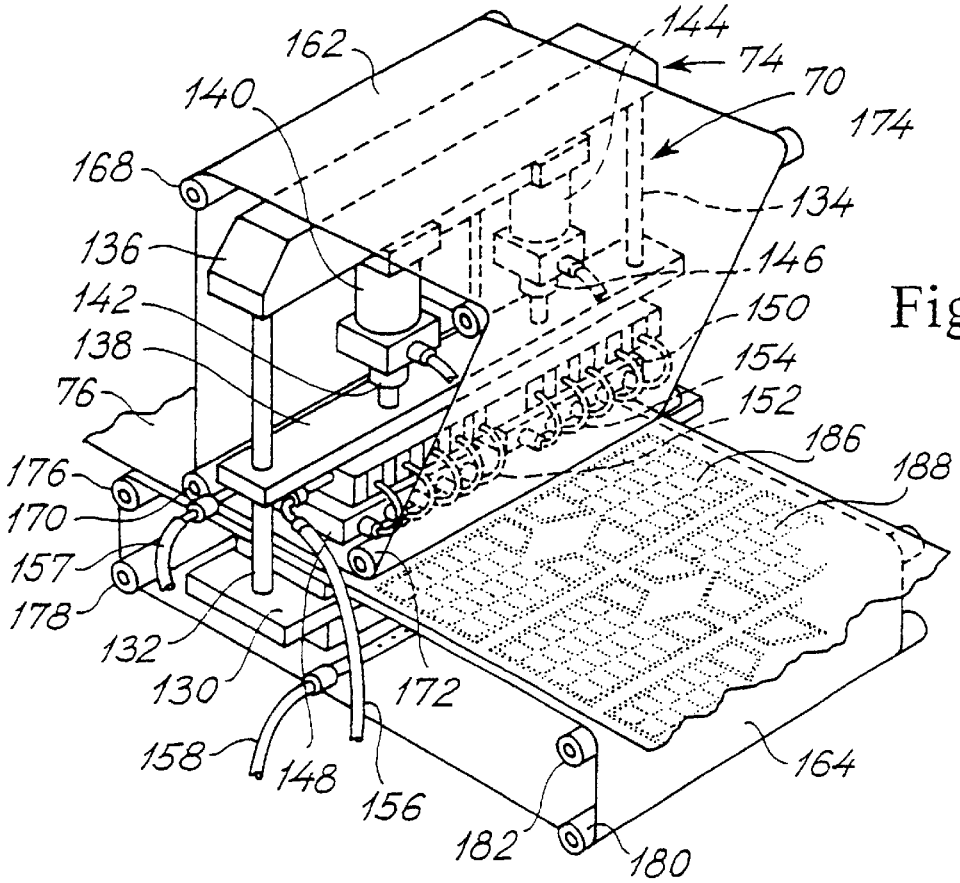
Fig. 21
Fig. 22
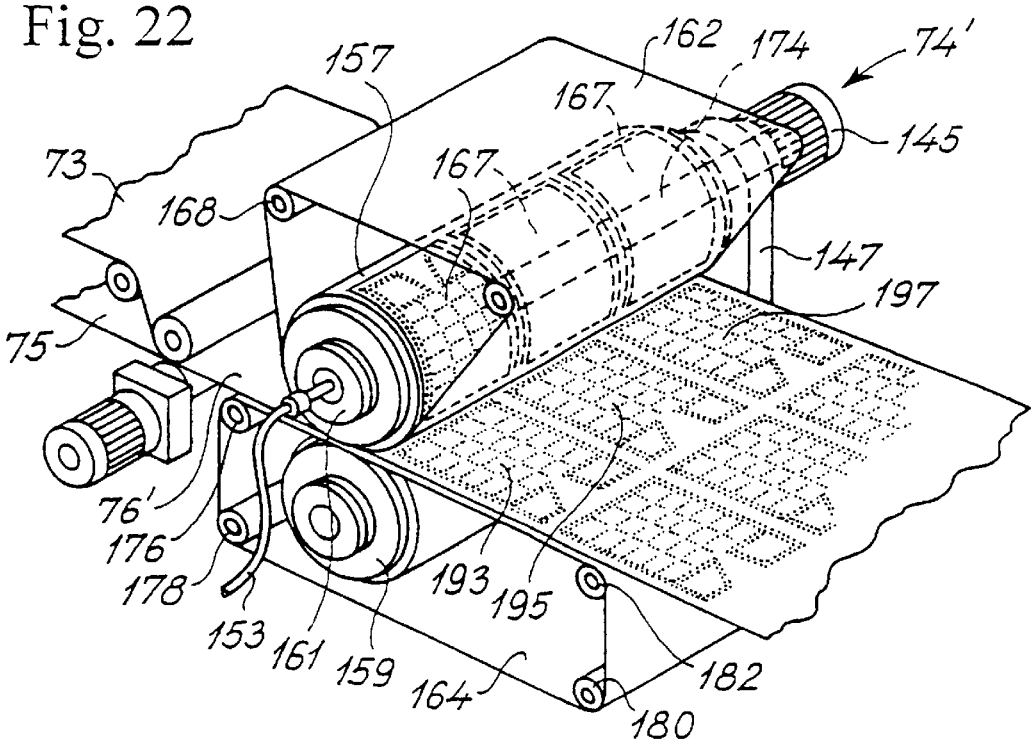

ICE CUBE BAG AND METHOD OF PRODUCING ICE CUBE BAGS

CROSS-REFERENCE TO RELATED APPLICATION

This application is a Continuation of co-pending International Application No. PCT/DK98/00539; filed Dec. 09, 1998.

BACKGROUND OF THE INVENTION

The present invention relates to an ice cube bag comprising:

- two sheet-shaped foil layers having substantially identical geometrical configurations and defining an outer periphery,
- a peripheral joint extending along the major part of the outer periphery of the foil layers with the exception of a peripheral area constituting an inlet channel of the bag which peripheral joint joins the foil layers together mainly overlapping each other and defining an inner chamber in the interior of the bag which inner chamber is divided into several ice cube compartments being defined in relation to each other by separate joints of the foil layers,
- an inlet channel defined by joints of the foil layers and extending from the inlet channel to the inner chamber of the bag so that admission is allowed from the surroundings to the inner chamber of the bag through the inlet channel.

Numerous ice cube bags are known within this technical field, e.g. from U.S. Pat. Nos. 3,207,420, Re.31,890, 4,822,180 corresponding to European patent No. 0 264 407, published European patent application No. 0 129 072, international patent application, publication No. WO82/00279, international patent application, publication No. WO87/01183 corresponding to European patent No. 0 248 817, international patent application, publication No. WO86/04561, international patent application, publication No. WO92/15491 corresponding to European patent No. 0 574 49 and published European patent application No. 0 619 948 and Danish patent No. 172.066 corresponding to published European patent application No. 0 795 393. In these numerous publications to which reference is made and which are hereby incorporated in the present specification by reference a large number of ice cube bag constructions of different embodiments having different closure devices are described, including knot closure, self-closure etc. Within this technical field it is commonly known that ice cube bags may either be glued or welded, the above mentioned Danish patent and the corresponding published European patent application describing an industrial method for production of ice cube bags having continuous or intermittent weldings.

It is commonly known within this technical field that ice cube bags with very strong joints, especially weldings or glueings may be produced, providing a safe and reliable containment of the ice cubes produced by means of the ice cube bag. Similarly it is generally realized that it may often be quite difficult for a user to open an ice cube bag in which ice cubes are contained, as the foil used, especially the commonly used polyethylene plastic foil and the rather strong joints, makes a tearing apart or opening of the ice cube bag quite difficult. In international patent application, publication No. WO87/01183 and corresponding European patent No. 0 248 817 an ice cube bag construction is described in which glueing is preferably used for establishing joints in the interior of the ice cube bag. The joints are later on relatively easy to separate again enabling a conversion of the ice cube bag from an ice cube bag divided into compartments into a non-compartmentalized ice cube bag. In the European patent it is stated that the joints enabling a conversion of the ice cube bag from a compartmentalized ice cube bag into a non-compartmentalized ice cube bag may be established as weldings or alternatively as glueings, as it should be possible for a person skilled in the art to deduce a technique to establish weak weldings enabling such a tearing apart of the joints for the purpose of converting the ice cube bag from a compartmentalized into a non-compartmentalized form. In this connection, in the European patent it is specifically stated that tearing apart of the joints, especially the glueings is not to cause any damage to the walls of the ice cube bag, i.e. cause a proper tearing of the ice cube bag, but only a separation of the joints previously established.

SUMMARY OF THE INVENTION

The present invention is based on the problem or the object of providing an ice cube bag of the type mentioned in the introduction in which it is possible in a simple manner to provide a tearing apart of the ice cube bag when a number of ice cubes have been produced in the ice cube bag by inserting water into the ice cube bag which is thereafter brought to freeze by positioning the ice cube bag containing water in a deep freezer, a home freezer, a freezer locker or the like. This problem or this object comprises per se a contradiction, as on the one hand a reliable sealing of the ice cube bag is provided so as to avoid an unintended leakage due to weak joints provided in the ice cube bag, including weldings or glue connections that may at an inappropriate point in time break and thus provide a leakage. On the other hand, the desire for providing an ice cube bag in which it is easy for the user to get into the interior of the ice cube bag in order to take out the ice cubes confined in the interior of the ice cube bag indicates that the joints should be weak and thus facilitate the tearing apart of the ice cube bag.

The invention is based on the realization that by means of suitable geometrical designing of the joints providing the separation of the inner chamber of the ice cube bag into numerous ice cube compartments it is possible to design these joints in such a way that these joints which are preferably produced by means of the same technique and same strength as the other joints in the ice cube bag may provide an opening of the ice cube bag after producing ice cubes or lumps of ice by freezing the water contained in the inner chamber of the ice cube bag.

The above mentioned object is obtained by means of an ice cube bag according to the present invention, and the above mentioned problem is solved in accordance with the teachings of the present invention by designing the ice cube bag mentioned in the introduction in such a manner that each of the separate joints defining two neighbour ice cube compartments in relation to each other is constituted by a number of individual joints and that each of these individual joints establishes a connection between the two sheet-shaped foil layers with such a joint strength and with such limited area extension that the joint in question is not broken when the foil layers are exposed to a separative force, but produces a tearing apart or perforation in one of the foil sheets along the periphery of the joint in question.

An embodiment of the ice cube bag characteristic of the present invention is characterized by the joints producing the definition of the ice cube compartments in the interior of the ice cube bag being constituted by a number of individual joints each establishing such a joint between the two sheet-shaped foil layers of the ice cube bag that the joint in question cannot per se be torn apart or broken, but at the same time, due to the limited area extension of the joint in question, enables the joint to produce a tearing apart or perforation of one of the foil layers in the ice cube bag when the two sheet-shaped foil layers of the ice cube bag are pulled from each other and are sought to be separated. In this connection, firstly it should be noted that this tearing apart or perforation is not per se conditioned on any specific force orientation, but in accordance with the teachings of the present invention it has turned out to be advantageous that the freezing of the water in the interior of the ice cube bag into lumps of ice produces a stretching of the foil layers so that a simple bending of the ice cube bag may in itself produce the necessary tearing apart or perforation of one of the foil layers of the ice cube bag as the stretched foil layers thus produce a considerable pull in one of the sheet-shaped foil layers in which a tearing apart or perforation is accordingly produced.

Secondly, it should be noted that the separate joints characteristic of the present invention must not be mixed up with the indication in the above mentioned European patent No. 0 248 817 stating that suitable surface weldings may be constructed by means of micro weldings which may be separated in accordance with the technical effect desired in the European patent in question. Unlike this technical effect described in above mentioned European patent No. 0 248 817, in accordance with the present invention a proper breaking by tearing apart or perforating one of, the other of or both of the two sheet-shaped foil layers is produced when the ice cube bag according to the present invention is intended to be opened or broken.

Furthermore, it should be noted that the embodiment of the ice cube compartment separating joints characteristic of the present invention due to the very limited area extension of these joints is conditioned to a better compartment utilization of the ice cube bag as compared to known commercial ice cube bags, since the ice cube bag of the kind as described in the below example may hold a total liquid volume of 480 g and commercially available ice cube bags hold typical liquid volumes of the order of 280–370 g.

In accordance with the present invention the characteristic advantage is furthermore obtained that the individual ice cube compartments may be filled through the corner connections between the individual ice cube compartments unlike the conventional ice cube bags having, on the contrary, the ice cube compartment defining or separating joints in the corners between the individual ice cube compartments. Thus, an easier and quicker filling of the interior of the ice cube bag is obtained as compared to the prior art commercial ice cube bags, and a bigger inner volume, i.e. liquid volume, is obtained in the ice cube bag.

The individual joints characteristic of the present invention forming the definition of the ice cube compartments in the inner chamber of the ice cube bag are, as it will be described in the following, typically positioned in lines in an orthogonal pattern in the ice cube bag which conditions the use of a minimum surface area of the two sheet-shaped foil layers for establishment of the ice cube compartmentalizing joints and at the same time a well-defined delimitation of the final ice cubes or lumps of ice contained in the ice cube bag as the ice cubes will typically be defined by straight lines according to the above mentioned orthogonal pattern.

For increasing the technical effect of the tearing apart or producing perforations in one of the foil layers in the ice cube bag according to the present invention when the ice cube bag is intended to be torn apart or opened it is preferred that the individual joints mentioned are positioned in such mutual distance that the individual joints when being torn through or perforated in one of the foil layers produce directions for a perforation line in one of the foil layers, thereby obtaining an especially simple tearing apart or opening effect.

In connection with the foils commonly used today in the industry, especially polyethylene foils, it has in accordance with the teachings of the present invention turned out that the effect characteristic of the present invention, i.e. a tearing apart or perforation effect by means of breaking through or opening the ice cube bag, is obtained by the factor calculated as the area of the individual joint expressed in square millimeters divided by the circumference or perimeter of the same joint measured in millimeters lies within the area 0.025 mm and 0.5 mm, preferably within the area 0.125 mm and 0.375 mm, such as approximately 0.25 mm.

In connection with commercially used foils, tests have demonstrated that the technical effect characteristic of the present invention may be obtained by each of the individual joints mentioned having an area extension corresponding to the area of a circle having a diameter of between 0.1 mm and 5 mm, such as 0.5 mm and 1.5 mm, preferably between 0.9 mm and 1.0 mm, such as between 0.5 and 0.8 mm, between 0.8 mm and 1 mm, between 1 mm and 1.2 mm or between 1.2 mm and 1.5 mm.

Even though in connection with the development of the realization based on the present invention the inventor has solely performed tests with welding of the sheet-shaped layers for production of ice cube bags it must be contemplated that the technical effect characteristic of the present invention of providing the opening or tearing apart of the ice cube bag by tearing apart or perforating one of the foil layers may just as well be obtained by using gluing techniques. It is a characteristic feature of the present invention, as already described above, that all the joints in the ice cube bag may advantageously be produced by means of only one technique and preferably in the one and only process, e.g. a welding process, which results in a substantially higher production price as compared to a process in which inner compartment-separating joints are produced by means of one technique, whereas the peripheral joints are produced by means of another technique. Thus, in accordance with the present invention, the presently preferred embodiment of the ice cube bag demonstrates the feature that the peripheral joint as well as the inlet channel defining joints and the individual joints mentioned are all constituted by glueings or preferably weldings.

The individual joints mentioned above which are characteristic of the present invention for production of the above mentioned tearing apart or perforation of one of the foil layers, the other one of the foil layers or both foil layers along the periphery of the joint in question may, indeed, be of arbitrary geometrical configurations even though it is presently preferred that the joints in question are of circular configuration. Alternatively, these individual joints may have the configurations of ellipses, line segments, triangles, rectangles, squares, polygons, arbitrary convex or concave contour defining configurations or combinations of any of the above mentioned configurations.

In accordance with two alternative embodiments of the ice cube bag according to the present invention, the ice cube bag of one of these embodiments are designed as a self-closure bag in which the two sheet-shaped foil layers provide prolongations forming two closure valve flaps positioned at the inlet aperture and extending from the inlet aperture and into the interior of the bag towards the inner chamber of the bag along the inlet channel and which are joined by means of the aforementioned inlet channel defining joints so that two closure pockets are provided which are open towards the inner chamber of the bag, whereas the ice cube bag according to the second embodiment constitutes a bag with a knot closure, perforations or cuts being provided in the two sheet-shaped foil layers outside the inlet channel defining joints in order to enable tying of the foil material on the two sides of the inlet channel for provision of a closure knot closing the inlet channel.

As mentioned above the ice cube bag may preferably be produced from a plastics foil material, especially polyethylene, preferably LDPE or HDPE or another glueable or weldable foil material, preferably plastics or polymer foil material or aluminum foil material or combinations of such foil materials, e.g. plastics coated aluminum foil material.

The ice cube bag according to the present invention may in accordance with alternative embodiments be provided with or configurated with a large or a small number of ice cube compartments, i.e. be provided with two or more ice cube compartments. In certain embodiments the ice cube bag may have a very limited number of individual ice cube compartments, e.g. two, three or four ice cube compartments, thereby obtaining by means of a given size of the two sheet-shaped foil layers of which the ice cube bag is produced relatively big ice cubes or lumps of ice for industrial appliance or for consumer appliance. In the presently preferred embodiments of the ice cube bag according to the present invention, however, it preferably demonstrates a larger number than four, e.g. 6, 8, 10, 12, 14, 16, 18, 20, 22, 24, 30 or 36 ice cube compartments. However, also embodiments having an odd number of ice cube compartments, e.g. 15 or 21 ice cube compartments, are possible. An embodiment of the ice cube bag according to the present invention having one single ice cube compartment defined in the interior of the ice cube bag may furthermore be implemented for special purposes.

The individual ice cube compartments in the ice cube bag may be individually defined by the individual joints characteristic of the present invention, but may alternatively be grouped in separate sub-compartments, thereby making it possible by opening or tearing apart of the ice cube bag only to take out a limited number of ice cubes from the ice cube bag instead of taking out all the ice cubes from the ice cube bag.

As it will be explained in further details below, the configuration, the orientation and the mutual distance between and the position of the individual joints defining the ice cube compartments in the interior of the ice cube bag determine a larger or minor degree of tendency to utilize the tearing apart or perforation technique characteristic of the present invention. Furthermore, as it will also be explained below, it is contemplated that the number of individual joints defining two neighbour ice cube compartments in relation to each other is per se of importance for obtaining the function characteristic of the invention, as also the number of individual joints either in the form of an odd number or an even number is of importance as to whether the generation of tearing apart or perforating one of the foil layers of the ice cube bag by means of opening or tearing apart the ice cube bag will be of importance.

Even though the ice cube bag according to the present invention may be produced from in fact arbitrarily configurated sheet-shaped foil layers, including non-rectangular foil layers, e.g. elliptical, polygonal or triangular foil sheets, it is preferred that the two sheet-shaped foil layers are substantially rectangular.

In accordance with special supplementary features of the ice cube bag according to the present invention, the ice cube bag is preferably—as it will be described below—provided with expansion chambers positioned on the one or both sides of the inlet channel, one or more connections being established from the inner chamber of the ice cube bag to the expansion chamber or expansion chambers in question.

In order to further facilitate the tearing apart or opening of the ice cube bag according to the present invention, tearing perforations for direction of tearing apart of the ice cube bags may be provided in the two sheet-shaped foil layers outside the inlet channel as it will also be explained in the following, thus making it possible in combination to utilize the tearing apart or perforation, characteristic of the present invention, of one of the foil layers in the ice cube bag and at the same time tearing apart the ice cube bag by means of the aforementioned tearing perforations.

A special aspect of the present invention relates to an ice cube bag especially for freezing of ice lumps or ice cubes and more especially an ice cube bag with a self-closure function and comprising:

two sheet-shaped foil layers having substantially identical geometrical configurations and defining an outer periphery a peripheral joint extending along the major part of the outer periphery of the foil layers with the exception of a peripheral area constituting an inlet aperture of the bag which peripheral joint joins the foil layers together mainly overlapping each other and defining an inner chamber in the interior of the bag which inner chamber constitutes at least one ice cube compartment and preferably several ice cube compartments being connected to each other and being defined by separate joints of the foil layers, an inlet channel defined by separate joints of the foil layers and extending from the inner chamber of the bag to the inlet aperture hereby allowing admission from the surroundings to the inner chamber of the bag through the inlet channel, two closure valve flaps being connected with the foil layers at the inlet aperture and extending from the inlet aperture into the interior of the bag towards the inner chamber of the bag along the inlet channel, the closure valve flaps being joined with each other and joined to the foils through the separate joints defining the inlet channel so as to provide two closure pockets which are open towards the inner chamber of the bag, the inlet channel comprising a first and a second section which first section is provided immediately after the inlet aperture and which second section connects the first section to the ice cube compartment or compartments, which first section is of a configuration mainly tapering towards the ice cube compartment or compartments, a constriction being provided at the transition between the first and the second section and which inlet channel defining a first direction constituting the longitudinal direction of the channel and a second direction in a plane parallel with the two foil layers and perpendicular to the first direction.

Within the technical field numerous ice cube bags are known, e.g. from U.S. Pat. Nos. 3,207,420, Re.31,890, 4,822,180 corresponding to European patent No. 0 264 407, European patent application No. 0 129 072, international patent application, publication number WO82/00279, international patent application, publication number WO87/01183, international patent application, publication number WO86/04561, international patent application, publication number WO92/15491, corresponding European patent No. 0 574 496 and corresponding U.S. Pat. No. 5,527,012, to which patents and patent applications reference is made and which US patents are hereby incorporated in the present specification by reference. A method for production of ice cube bags of this kind is furthermore known from published Danish patent application No. 1029/96, claiming priority from Danish patent application No. 343/96 on the basis of which an international patent application No. PCT/DK97/00127 as well as an European patent application No. 96510031.5 have correspondingly been filed.

In the above mentioned re-issued U.S. Pat. No. Re.31,890 an ice cube bag is described and illustrated, vide FIG. 7 and the corresponding part of the specification, comprising two closure flaps which provide a check valve in a self-closing ice cube bag.

European patent No. 0 574 496 describes an ice cube bag of the kind mentioned in the introduction. In this prior art ice cube bag the closure valve flaps are preferably designed so that the closure valve flaps extend to a position in the centre of the second section of the inlet channel, but according to alternative embodiments described in this European patent the closure valve flaps may extend to a position either at the interior end of the inlet channel, i.e. substantially in the entire length of the inlet channel, or to a position immediately after the constriction. In any case, the ice cube bag described in this European patent is designed so that the closure valve flaps extend beyond the constriction. Furthermore, the ice cube bag described in European patent No. 0 574 496 is designed so that not only due to the closure valve flaps a static closure of the interior of the ice cube bag is provided, but also a dynamic closing function has been provided by means of a venturi effect as by means of the geometrical configuration of the second section of the inlet channel a dynamic closure of the interior of the ice cube bag is ensured by means of reliable filling of the closure pockets defined behind the closure valve flaps, even when these pockets are initially partly filled with air and thus not sufficiently filled with water.

European patent No. 0 264 407 similarly describes an ice cube bag in which the inlet channel is defined by a first weld seam providing a substantially funnel-shaped inlet from which inwardly at a position below the centre of the inlet channel supplementary weld seams are provided pointing at each other and which weld seams produce spikes pointing at each other for provision of a constriction in the inlet channel. The closure valve flaps in the ice cube bag known from this European patent extend from the inlet aperture substantially in the entire length of the inlet channel, but not beyond the inlet channel and thus into the interior of the ice cube bag.

It is a common feature of these ice cube bags that the achievement of a safe and reliable closure, especially a static closure of the interior of the ice cube bag, i.e. a closure after that the closure pockets defined behind the closure valve flaps have been totally filled with liquid or preferably with water, is considered to be conditioned on the closure valve flaps having a considerable length compared to the length of the inlet channel and in accordance with European patent No. 0 264 407 having a length substantially corresponding to the length of the inlet channel.

In accordance with the alternative embodiments described in European patent No. 0 574 496 the closure valve flaps may have a reduced length compared to the length of the inlet channel, but in any case the closure valve flaps have a length conditioning the closure valve flaps to extend beyond the constriction. Thus, it has been considered necessary for achievement of a safe and reliable static closure of the ice cube bag that the closure valve flaps should extend beyond the constriction.

This aspect of the present invention is based on the realization that it has turned out that a dynamic as well as a static safe closure of the interior of the ice cube bag may be achieved in ice cube bags of this type, even when the closure valve flaps have a minor length compared to the hitherto realized decisive criteria for achievement of a safe and reliable closure of the interior of the ice cube bag. Thus, by reducing the length of the closure valve flaps a number of substantial advantages are obtained:. Firstly a minor material consumption for the ice cube bag for obtaining the same inner volume in the interior of the ice cube bag compared to an ice cube bag in which the closure valve flaps extend in e.g. the total length of the inlet channel, secondly by means of the same material consumption a larger net inner volume in the interior of the ice cube bag, and thirdly resource savings as regards a minor water consumption as the liquid or water volume confined in the closure pockets is reduced proportionally to the reduction of the length of the closure valve flaps, and furthermore an energy saving as the liquid or water volume confined in the closure pockets defined behind the closure valve flaps, like the liquid or water volume confined in the interior of the ice cube bag, is to be brought to freeze and thus requires a cooling energy and therefore a reduction of the volume of the closure valve pockets correspondingly reduces the cooling energy necessary for freezing of the liquid or water quantity confined in the ice cube bag.

Thus, in accordance with this special aspect of the teachings of the present invention it has surprisingly turned out that for achieving a safe and reliable closure of the interior of the ice cube bag, statically as well as dynamically, it is sufficient that an ice cube bag of the kind described in the introduction is produced with closure valve flaps extending from the inlet aperture in the entire length, seen in the above mentioned first direction, of the first section of the inlet channel and to the constriction and the transition between the first and the second section of the inlet channel, but not beyond the constriction and into the second section of the inlet channel.

In accordance with this special aspect of the teachings according to the present invention a safe and reliable closure of the interior of the ice cube bag is thus ensured when the closure valve flaps defining the closure pockets extend to a position opposite the constriction, but not beyond the constriction and into the second section of the inlet channel.

In the patent specifications described above, especially in European patent No. 0 264 407, it is stated that it is of significant importance for achievement of a reliable closure function that the constriction is well defined and in the described and illustrated embodiment is produced of triangular, towards each other pointing extra weldings producing spikes pointing towards each other and defining the constriction of the inlet channel. Correspondingly, in European patent No. 0 574 596 two embodiments are illustrated in one of which the constriction is defined by spikes pointing towards each other and in the other of which the constriction defining joints are enforced by circular joint enforcements provided at the ends of the constriction defining joints.

In accordance with this special aspect of the teachings according to the present invention it has turned out that for achievement of a safe and reliable closure dynamically as well as statically of an ice cube bag of this kind it is not necessary that the constriction is defined by point-shaped or circular joints which may in certain cases involve technical difficulties as regards production of such sharply defined joints, especially when the joints are established by means of welding. In accordance with the presently preferred embodiment of the ice cube bag according to the present invention, the ice cube bag is according to a further realization characterized by the fact that the constriction at the transition between the first and the second section of the inlet channel is provided by joints containing no geometrical discontinuities and constituting extensions of the joints defining the first section of the inlet channel and the joints defining the second section of the inlet channel.

For achievement of the above mentioned first characteristic feature of this special aspect of the present invention, i.e. the feature that the closure valve flaps extend only from the inlet aperture to a position at the constriction, i.e. at the transition between the first and the second aspect of the inlet channel, but not beyond the constriction and into the second section of the inlet channel, the ice cube bag in accordance with the presently preferred embodiment of the invention is further preferably characterized by the closure valve flaps extending to a central position in relation to the constriction defined by the joints. When producing the ice cube bags of the above described kind which production is preferably made by joining continuous foil webs and subsequently cutting the joined foil webs, the positioning of the two sheet-shaped foil segments and the closure valve flaps in relation to these two sheet-shaped foil segments will under normal production circumstances inevitably vary a bit which has in practise no significance for the function or the appearance of the ice cube bag, but may render it difficult to fulfill the above described characteristic feature of this special aspect of the present invention, i.e. the positioning of the inner ends of the closure valve flaps opposite the constriction when the constriction is very short seen in the above mentioned first direction, i.e. in the longitudinal direction of the inlet channel. Thus, it has been realized that the constriction defining joints may be designed in a geometrical configuration diverging from spikes or circles, especially a configuration which does not contain the geometrical discontinuities, but may further be designed so that the constriction-defining separate joints demonstrate an extension in the above mentioned first direction, i.e. the longitudinal direction of the inlet channel which is not insignificant like a point-configurated joint seen i relation to the width, especially the maximum width between the constriction defining joints. In accordance with the above defined feature, i.e. being designed without geometrical discontinuities, these constriction defining joints may define a convex or concave constriction or alternatively and preferably a constriction defined by rectangular parallel joints.

At this point a short explanation will be given of the term "geometrical discontinuity" in this context and, by the way, also in accordance with well-known geometrical principles. A curve, especially the edge curve of a joint, defines a geometrical contour or curve configuration. This curve configuration defines a tangent in an arbitrary point of the curve and in this context a geometrically continuous curve means a curve the tangent of which alters its inclination continuously along the curve in question. Thus, a geometrical discontinuity means that at a given point, a continuity of the tangent of the curve does not exist, but a shift or jump exists from one tangent direction to a different tangent direction.

In accordance with the presently preferred embodiment of the ice cube bag according to this special aspect of the present invention and for fulfillment of the superior consideration that the quantity of water confined in the closure pockets has to be minimized for the reasons mentioned above, the first section of the inlet channel and the second section of the inlet channel are produced with mainly the same extension after the above mentioned first direction, i.e. in this preferred embodiment the constriction is, seen in the longitudinal direction of the inlet channel, positioned approximately in the middle of or preferably in the middle of the inlet channel.

In one embodiment of the ice cube bag according to this special aspect of the present invention the inlet channel is produced mainly symmetrically in relation to the central axis of the constriction in the above mentioned second direction, namely for fulfillment of the above mentioned feature that the first section of the inlet channel and the second section of the inlet channel are of mainly the same extension seen in the longitudinal direction of the inlet channel.

Similar to the above described prior art ice cube bags, the inlet channel is preferably produced mainly symmetrical in relation to the longitudinal axis of the channel.

The closure valve flaps of the ice cube bag according to this special aspect of the present invention may be constituted by separate flap-formed parts which may be produced from the same material as the foil segments of the ice cube bag or from another material having larger or minor flexibility. In the preferred embodiment of the ice cube bag according to this special aspect of the invention, the closure valve flaps are constituted by folded parts of the sheet-shaped foil web segments. Thus, according to the preferred embodiment of the ice cube bag according to this special aspect of the present invention, the closure valve flaps are constituted by integral components or parts of the foil web segments of the ice cube bag. If the closure valve flaps are constituted by separate components or parts, the closure valve flaps may be fixated to the foil web segments by means of joint which, dependent on the materials used for the foil web segments and the closure valve flaps, may be established by means of gluing or welding.

The ice cube bag according to this special aspect of the present invention may further preferably be produced in accordance with the technical teachings described in the above mentioned European patent No. 0 574 496 and thus be produced with a dynamic self-closure function which is in the above mentioned European patent designated a venturi-closure. In this connection reference is made to the above mentioned European patent for a further description of this function as in accordance with this teaching the ice cube bag may be produced so that the constriction at the transition between the first and the second section serves the purpose of providing a venturi effect for generation of a relative drop of pressure in the constriction for closure of the channel at the constriction when liquid flows from the second section through the constriction towards the first section for generation of a self-closing effect.

The ice cube bag according to this special aspect of the present invention may furthermore in accordance with the technical teachings described in the above mentioned European patent No. 0 574 496 be produced so that the second section comprises a chamber which is well-defined by joints abutting on the constriction and diverging substantially in the second direction and which is connected by means of side joints to further joints abutting to the above mentioned ice cube compartment or compartments and converging in the second direction to at least one passage leading into the interior of the ice cube bag.

Furthermore, in accordance with the presently preferred embodiment of the ice cube bag according to this special aspect of the present invention it is preferred that the second section has a maximum dimension in the second direction of at least twice the dimension of the constriction in the same direction for provision of a liquid and water reservoir from which liquid may unhindered flow towards the inlet aperture through the constriction after that the ice cube bag has been filled with liquid or water through the inlet aperture in a first position in which the inlet aperture turns upwardly and after that the ice cube bag has been turned into another position in which the inlet aperture turns downwardly.

In this presently preferred embodiment of the ice cube bag according to this special aspect of the present invention it is furthermore preferred that the maximum dimension of the second section in the second direction of the inlet channel is 2–7 times the dimension of the constriction, preferably 2.4–5 times the dimension of the constriction, such as 2.6–3.4 times the dimension of the constriction.

In the first place, the first section of the inlet channel serves the purpose of providing an inlet channel which may safely lead the water supplied by e.g. the spout of a tap, into the interior of the ice cube bag and thus preferably provides a funnel-shaped inlet part in the first section of the pinlet channel. For provision of such an inlet funnel provided by the first section of the inlet channel it is preferred that the dimension of the first section of the channel along the second direction of the inlet channel at the above mentioned inlet aperture is approximately twice the dimension of the constriction in the above mentioned second direction.

For provision of such a funnel-shaped first section of the inlet channel, the first section of the channel is preferably defined by joints constituting straight lines or curved lines forming either a convex or a concave first section of the channel. Alternatively, the first section of the channel may constitute a non-funnel-shaped part, but just an inlet pipe or even a converse funnel-shaped configuration or form.

Similarly to the first section preferably being produced by joints constituting straight or curved lines, the second section of the inlet channel is preferably defined by joints constituting partly straight lines, partly curved lines, such as segments of circles defined by the second section of convex or concave configuration or symmetrical form in the above described reversed symmetrical embodiment in relation to the first section of the inlet channel.

From Danish patent No. 172,066 and corresponding published European patent application, publication No. 0 795 393, a method for producing ice cube bags or corresponding bags from welded plastic foils is known. In the industry, this method has turned out to be very advantageous as the method has made possible the production of ice cube bags or corresponding bags from very thin plastic foils with an error frequency of practically zero, i.e. less than one error per 1 million bags.

In accordance with a special embodiment, the above described ice cube bag according to the present invention may be established with solely point weldings or line segment weldings, peripheral weldings and other weldings, which are in conventional ice cube bags established by means of line weldings, instead in accordance with the teachings of the present invention being established as weldings composed of point weldings or line segment formed weldings.

Such an ice cube bag having solely point weldings or line segment formed weldings enables a further development of the method known from the above mentioned Danish patent and the above mentioned published European patent application which further development makes it possible to reduce the time during which the softened or at least partly melted plastic foils after fulfillment of a stamping or welding operation are supported by the web of temperature resistant material, as exactly the point or line segment formed weldings between each other generate areas of non-welded and thus non-melted foil material which provides a reinforcement and strengthening of the plastic foils during conveyance of the plastic foils after the stamping or welding operation compared to conventional ice cube bags having line formed weldings.

Accordingly, the method described in the above mentioned Danish patent and above mentioned corresponding published European patent application may in accordance with a further aspect of the present invention be further developed by under item iii) performing a stamping or welding operation during which the above mentioned intended stamped or welded areas of the final ice cube bag or corresponding bag demonstrate weldings constituted by individual point or line segment formed weldings in which between the point or line segment formed weldings non-welded material exist constituting a coherent area of non-welded material, and that the tearing away of the web of high temperature resistant material from the adhesion to the plastic foils under item v) is performed immediately after the stamping or welding operation.

In accordance with this special aspect of the present invention the method may further advantageously be implemented by means of the embodiments stated in the subclaims 33–46.

BRIEF DESCRIPTION OF THE DRAWINGS

In the following the invention will be described in further details with reference to the drawing in which

FIGS. 21 and 22 are schematic and perspective views of two alternative embodiments of a plant for production by welding of the ice cube bag according to the present invention.

DETAILED DESCRIPTION OF THE INVENTION

Figure 1A:
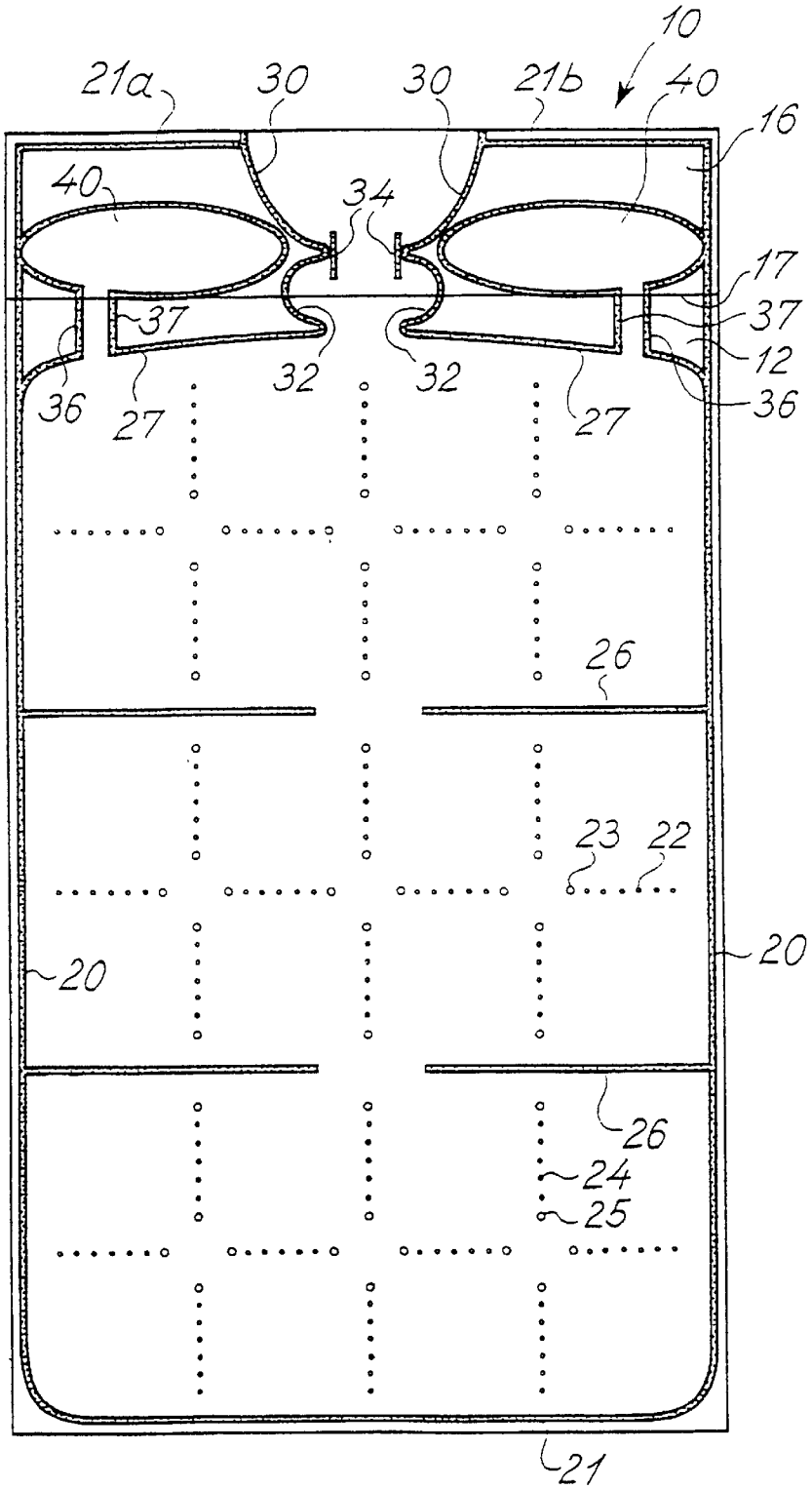
FIG. 1*a* is a schematic side view of a first, preferred embodiment of an ice cube bag according to the present invention.
Figure 1B:
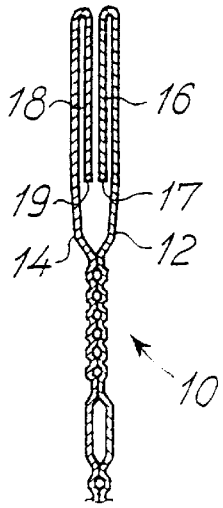
FIG. 1*b* is a sectional view of the upper part of the first, preferred embodiment of the ice cube bag according to the present invention illustrated in FIG. 1.

FIGS. 1*a* and 1*b* are schematic, plane and sectional views, respectively, of a presently preferred embodiment of an ice cube bag according to the invention. The ice cube bag is designated in its entirety the reference numeral 10. The ice cube bag is composed of two identical plastic foils, preferably LD-polyethylene foils of a thickness of 25 $\mu$m or alternatively HD polyethylene foils of a thickness of 18 $\mu$m which foils are designated the reference numerals 12 and 14. Each of the foils have a folded part designated the reference numerals 16 and 18, respectively, and protruding inwardly into the interior of the ice cube bag 10 and forming inner laid-open edges, 17 and 19, respectively. The foils 12 and 14 are of substantially rectangular configuration and are positioned over-lapping each other with the folded parts 16 and 18 as mentioned above protruding inwardly in the interior of the ice cube bag 10, the foils 12 and 14 being joined by means of two side weldings 20, a bottom welding 21 and two top weldings 21*a* and 21*b*, together constituting a circumferential, continuous welding extending along the periphery of the foils 12 and 14, except for a line segment defining an inlet channel to the interior of the ice cube bag between the two top weldings 21*a* and 21*b*. The interior of the ice cube bag 10, i.e. lying inside the aforementioned circumferential continuous welding defined by the two side weldings 20, the bottom welding 21 and the two top weldings 21*a* and 21*b*, may be considered comprising two parts, an inlet channel positioned at the upper end of the ice cube bag and an interior compartmentalized ice cube compartment.

At this stage it should be noted that expressions such as "upwardly", "downwardly", "upper", "lower", "horizontal", "perpendicular" etc. referring to the orientation of the ice cube bag in relation to vertical orientation determined by the gravitational force are to be construed as expressions solely serving the purpose of describing the usual, general orientation of the ice cube bag in use, specially when it is being filled with water, as a larger or minor part of the ice cube bag may of course be folded in relation to a specific orientation, such as vertical orientation, or the ice cube bag may in its entirety be held in a sloping position in relation to a specific orientation, e.g. in relation to the vertical orientation.

The inlet part positioned at the upper end of the ice cube bag is defined by two mirror-symmetrical welding sets defining an inlet channel leading from the above mentioned inlet aperture defined between the two top weldings 21*a* and 21*b* and into the aforementioned interior ice cube chamber in the ice cube bag 10. The inlet channel is substantially designed in accordance with the technical teachings and the technical principles defined in European patent No. 0 574 496 and in published European patent application No. 0 616 448 to which reference is made, and these two publications are hereby incorporated in the present specification by reference. More specifically, the inlet channel is defined by weldings 30 converging from the inlet aperture towards the inner ice cube chamber of the ice cube bag which at a constriction in the inlet channel extend into two symmetrically positioned, mainly semicircular weldings 32, the transition between the weldings 30 and 32 constituting the aforementioned constriction in the inlet channel which constriction is further limited by two parallel rectilinear weldings 34. The lower parts of the semicircular weldings 32 are extended into two outwardly sloping and diverging weldings 27 being connected to the two side weldings 20, these two outwardly sloping and diverging weldings 27 being broken for producing two upwardly directed channels positioned symmetrically in relation to the inlet channel which aforementioned upwardly directed channel are defined individually by two parallel weldings 36 and 37 and extend into respective expansion chambers 40 being defined by a mainly elliptically configurated welding 38, extended into an associated side welding 20 and positioned behind a respective rectilinear welding 34. The expansion chambers 40 and the associated sets of parallel weldings 36 and 37 may be omitted.

The aforementioned weldings 30 converging towards each other constitute a first part of the inlet channel whereas the aforementioned semicircular weldings 32 constitute a second part of the inlet channel. As it is evident from FIG. 1*a*, the folded parts 16 and 18 of the foils 12 and 14 extend downwardly to a position immediately opposite the middle of the second part defined by the aforementioned elliptically configurated weldings 38. It should be noted that also other positions of the lower edges 17 and 19 of the folded parts 16 and 18, respectively, in relation to the semicircular-configurated weldings are possible, e.g. as described and illustrated in the above mentioned European patent and in the above mentioned published European patent application. Furthermore, it should be noted that the folded parts 16 and 18 of the foils 12 and 14, respectively, may be punched away so that the folded foil material only is present in the inlet channel proper and immediately outside the inlet channel, but cut away along the outer sides of the inlet channel where, accordingly, instead of the weldings 36 and 37 and the expansion chambers 40, further ice cube compartments may be present in accordance with the teachings of the present invention as it will be described in the following.

As is evident from FIG. 1*a*, the aforementioned inner compartmentalized ice cube chamber is furthermore divided into three sub-compartments which will in the following be designated the upper, the middle and the lower sub-compartments, respectively, two line weldings 26 extending from each of the two side weldings 20 inwardly towards the middle line of the ice cube bag. These in total four line weldings 26 have a length constituting less than half of the inner free width between the side weldings 20 so that between each pair of the line weldings 26, which are aligned, an aperture is formed between the adjacent sub-compartments for allowing water to flow from the upper sub-compartment, further down into the middle sub-compartment and still further down into the lower sub-compartment.

The individual sub-compartments, i.e. the above mentioned three sub-compartments, are furthermore divided into eight ice cube compartments each by means of point weldings, four sets of horizontal point weldings and three double sets of perpendicular point weldings being provided in each of the three sub-compartments. In this context, the expression horizontal point weldings is to be construed an expression not referring to the individual point weldings being horizontal, as the point weldings are of circular or approximately circular configuration, but on the contrary expressing that the line or other curve on which the point weldings are positioned extend in a horizontal or substantially horizontal orientation. Correspondingly, the expression perpendicular point weldings is to be construed so that the point weldings in question are positioned on a curve, preferably a line, extending in a perpendicular or approximately perpendicular orientation. The three double sets of perpendicular point weldings and the four sets of horizontal point weldings in each sub-compartment meet in areas constituting connection areas between the ice cube compartments in which connection areas weldings connecting the two foils 12 and 14 with each other are not provided.

The point weldings in the four sets of horizontal point weldings and correspondingly the point weldings in the three double sets of perpendicular point weldings adjoining the connection areas mentioned are made with a larger extension than the other point weldings. Each of the four sets of horizontal point weldings thus constitutes five point weldings designated the reference numeral 22 which point weldings are typically of the size 0.1–5 mm, such as 0.5–1 mm, e.g. 0.6–0.9, preferably approximately 0.9 mm, the two sets of horizontal point weldings adjoining the side weldings 20 each constituting a sixth point welding 22. Each of these two sets of point weldings adjoining the side weldings 20 constitutes two point weldings designated the reference numeral 23 which point weldings have a larger diameter compared to the point weldings 22, typically a diameter of more than 0.5 mm, such as more than 1 mm, e.g. a diameter of 1–1.5 mm, e.g. a diameter of 1.1–1.3 mm, preferably a diameter of 1.1 mm. Each of the two middle sets of horizontal point weldings constitutes, as it will be evident from the description below, five point weldings 22 and two point weldings 23. The three double sets of perpendicular point weldings each comprises, corresponding to the two middle sets of horizontal point weldings 5, point weldings 24 corresponding to the point weldings 22 and two point weldings 25 corresponding to the point weldings 23.

The above described first preferred embodiment of the ice cube bag 10 is illustrated in a plane condition where the two foils 12 and 14 are positioned abutting planely on each other, the inner ice cube compartments of the ice cube bag and correspondingly the inlet channel and the expansion chambers being partly filled with air, but is illustrated in a non-filled condition, i.e. in a condition in which water has not yet been filled into the interior of the bag.

In FIG. 1*b* the upper part of the ice cube bag 10 is illustrated in a sectional view along the line 1—1 in FIG. 1*a* illustrating the two foils 12 and 14, the two folded parts 16 and 18 of the foils and the lower edges 17 and 19 of these folded foil parts 16 and 18. Furthermore, in FIG. 1*b* the total of seven weldings are illustrated in the upper perpendicular point welding set comprising two point weldings 25 and five point weldings 24 positioned between these two point weldings 25.

The difference in size between the point weldings 22 and 23 and correspondingly the point weldings 24 and 25 are conditioned by a desire to have no immediately neighbouring point weldings, i.e. the point weldings 23 and 25, are not torn apart during filling with water and during freezing of the water, as it must be recalled that when cooled below 4° C. water expands and continues to expand during freezing, causing a given quantity of liquid contained in the interior of the ice cube bag during freezing to expand and thus exercising a larger pressure in the interior of the bag and thus a conditioned larger pull in the weldings defining the interior of the ice cube bag and dividing the interior of the ice cube bag into individual ice cube compartments.

Figure 2:
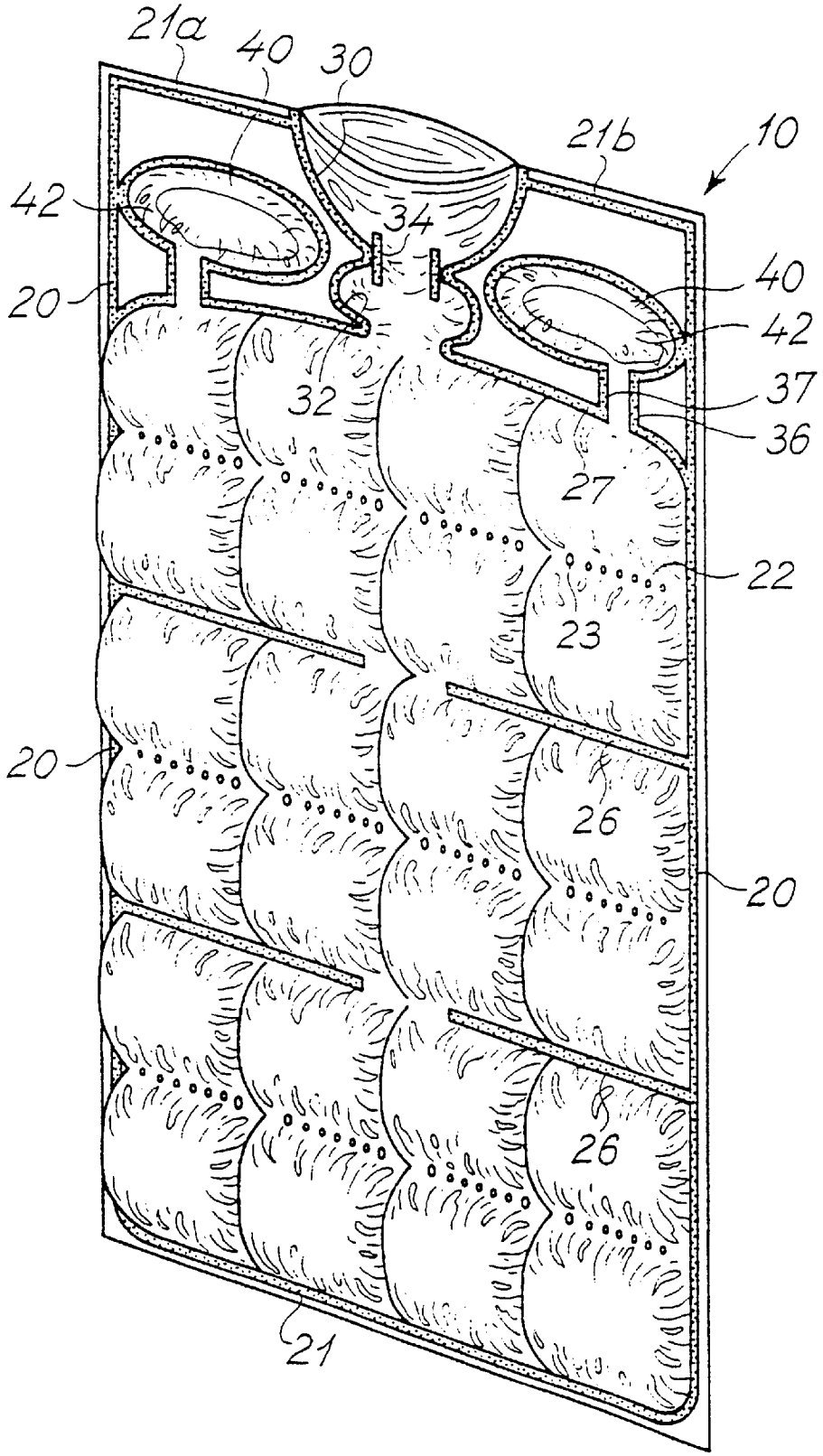
FIG. 2 is a schematic and perspective view of the first, preferred embodiment of the ice cube bag according to the present invention illustrated in FIGS. 1*a* and 1*b* after the ice cube bag has been filled with water and after the water has been frozen into ice for production of ice cubes confined in the ice cube bag.

FIG. 2 illustrates the first and preferred embodiment of the ice cube bag 10 illustrated in FIGS. 1*a* and 1*b* after the ice cube bag 10 has been filled with water, has been brought to close by means of self-closure effect as described in the above mentioned European patent and the above mentioned published European patent application and after the water contained in the interior of the ice cube bag and contained in the closure pockets defined behind the folded parts 16 and 18 of the foils 12 and 14, respectively, has been frozen. During the filling with water the individual ice cube compartments in the three sub-compartments of the ice cube bag are filled with water, and the water fills the interior of the inlet channel whereupon it runs into the aforementioned closure pockets when the bag is turned upside down. During the filling of the ice cube bag with water, the water will usually not extend into the two expansion chambers which are not vented whereafter minor air pockets will be confined in these expansion chambers. When the ice cube bag is thereafter turned upside down for production of the self-closure function the air in these air pockets is let out and distributed in the interior of the ice cube bag causing, correspondingly, water to penetrate into the expansion chambers 40. In this way, the liquid pressure in the interior of the ice cube bag is reduced. During freezing the water expands as explained above, causing the foils of the ice cube bag to be suspended as the foils do not burst due to expansion of the water, because of the pressure reduction provided by the expansion chambers 40, cf. the above explanation. In FIG. 2, the ice lumps produced by the water which has penetrated into the expansion chambers and frozen into ice therein are designated the reference numeral 42 and above these ice lumps a specific minor space of air is illustrated. Thus, it has to be recalled that during ordinary use, which is also a provision in connection with the frozen bag illustrated in FIG. 2, the ice cube bag is positioned in a deep freezer or a freezer locker resting on one of the foil walls, or rather the most backward and not visible foil wall in FIG. 2.

After freezing of the water as described above the individual ice cube compartments will be tightly distended by the ice cube confined in the ice cube compartment in question. Beside the individual ice cube compartment, the areas between the ice cube compartments, i.e. between the point weldings 23 and 25, are filled with ice distending the intermediate foil and through the foil perform a pull in these point weldings and the intermediate point weldings 22 and 24, and similarly the distension of the foils correspondingly conditions pulls in the confining line weldings, i.e. the two side weldings 20, the bottom welding 21, the outwardly sloping and diverging weldings 27 and the compartmentation line weldings 26. Thus, in accordance with the teachings of the present invention it has surprisingly turned out that this distension of the foils in combination with the limited area extension of the point weldings 22, 23, 24 and 25 illustrated in FIG. 1*a* makes a simple and predictable tearing apart of the foils 12 and 14 possible for the purpose of taking out the ice cubes from the interior of the ice cube bag.

Figure 3A:
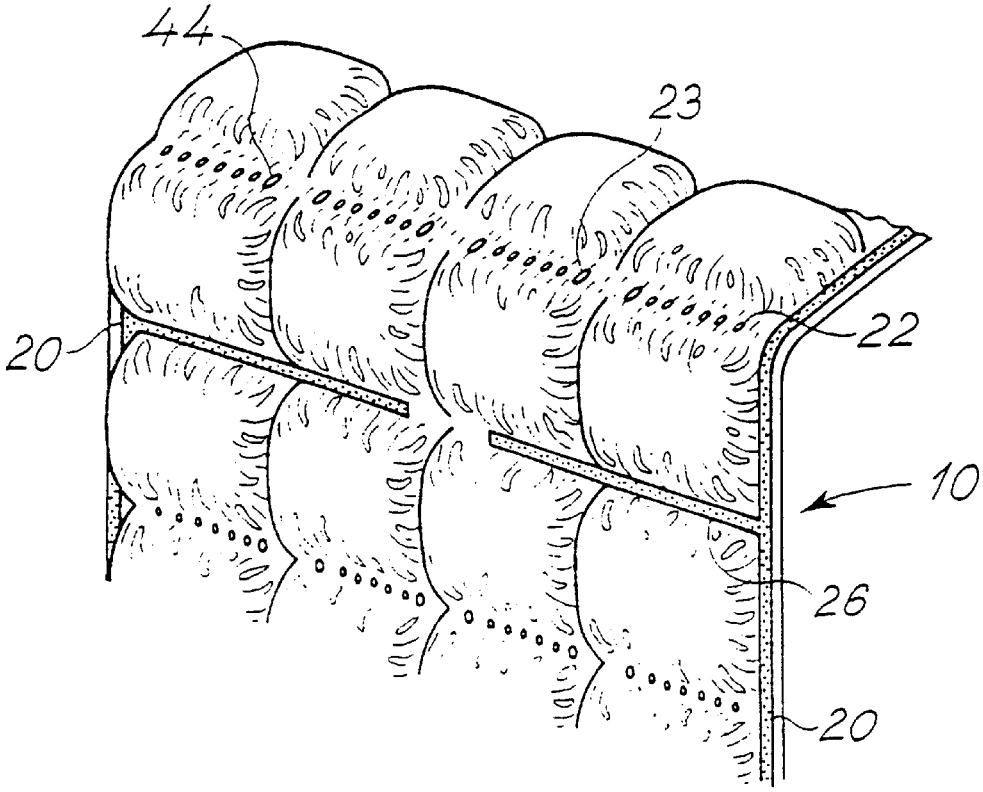
FIGS. 3*a* and 3*b* are schematic and perspective views of two steps during a process in which the ice cube bag illustrated in FIG. 2 and containing ice cubes is torn apart for the purpose of taking out the ice cubes confined in the ice cube bag.
Figure 3B:
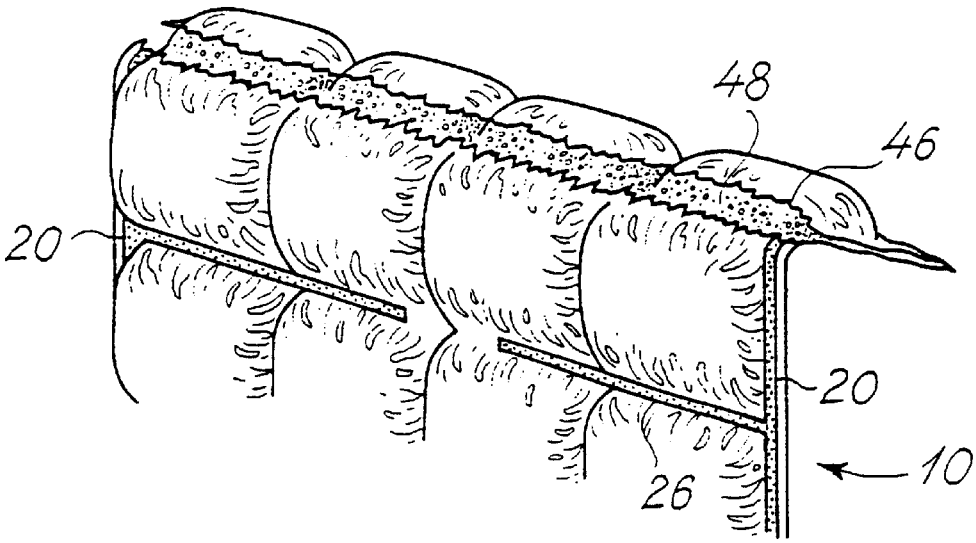

In FIGS. 3*a* and 3*b* this phenomenon is illustrated. In FIG. 3*a* the middle sub-compartment in the ice cube bag 10 illustrated in FIG. 2 is folded around an imaginary line through the middlemost horizontal point weldings in the ice cube bag, causing the exterior foil, i.e. the foil 12, to be distended above the ice cubes 12 confined behind the foil 12. In this manner, a pull in the foil 12 is performed which is in fact concentrated in the point weldings lying at the folding line and thus the folding of the ice cube bag results in tearing apart of these point weldings as the foil 12 is torn free of point weldings so that in the foil a number of perforations 33 are produced in places originally and until folding of the ice cube bag being provided with point weldings. Thus, as illustrated in FIG. 3*a*, the material from the point weldings will be torn free of the foil 12 and thereafter be in contact with the foil 14 lying behind.

When being continuously folded, the stretching of the foil 12 produces a further stretching in the produced perforations 44 which ultimatively as illustrated in FIG. 3*b* provides a complete tearing apart of the foil 12 according to a line through the perforations 44 described above with reference to FIG. 3*a*. In FIG. 3*b* the broken edge of one of the halves of the foil 12 is designated the reference numeral 46. Hereafter, the total of eight ice cubes, one of which is designated the reference numeral 48 and which was previously confined in the middle sub-compartment of the ice cube bag 10, are accessible and may immediately be taken out of the broken ice cube bag 10. In this connection it should be noted that when folding the ice cube bag it is possible by means of a very small force to provide an extremely large force in the areas of the foils abutting on the horizontal point weldings as by folding the ice cube bag a substantially torque arm is utilized compared to the torque arm transmitting the pull to the point weldings locally opposite the individual point weldings.

Figure 4A:
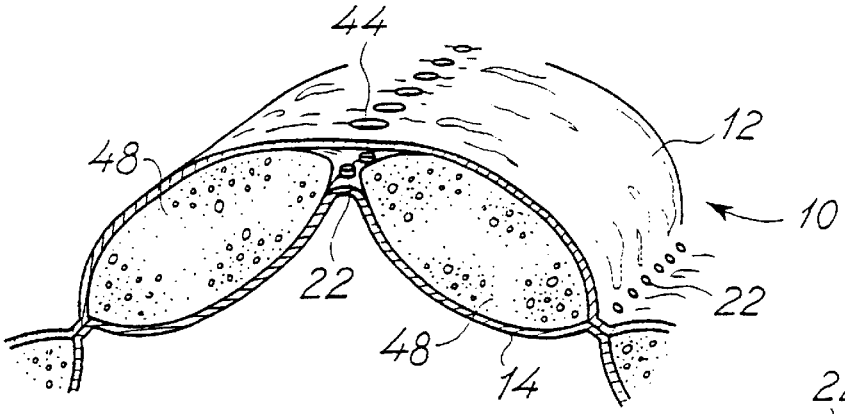
FIGS. 4*a* and 4*b* are perspective and sectional views in further details of the tearing apart operation schematically illustrated in FIGS. 3*a* and 3*b*.

FIG. 4*a* is a sectional and more detailed illustration of the tearing apart of the point weldings in FIG. 3*a* during the first part of the tearing apart or opening of the ice cube bag 10, FIG. 4*a* illustrating how the distension of the upper foil 12 and tightening of the foil above the ice cubes produce a tearing away of the foil 12 from the point welded areas and result in the generation of perforations 44 in the foil 12. The further folding of the ice cube bag 10 as illustrated in FIG. 4*b* provides a continuous stretching of the foil 12 which ultimatively cracks in the line 46 through the perforations 44 illustrated in FIG. 4*a*.

Figure 4B:
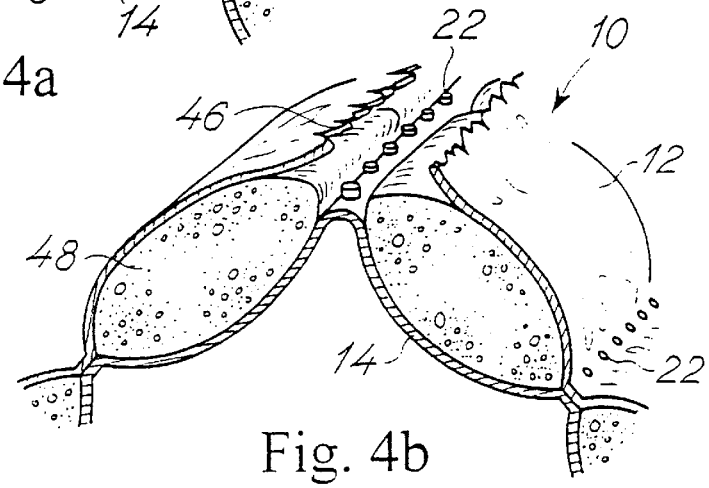
Figure 5:
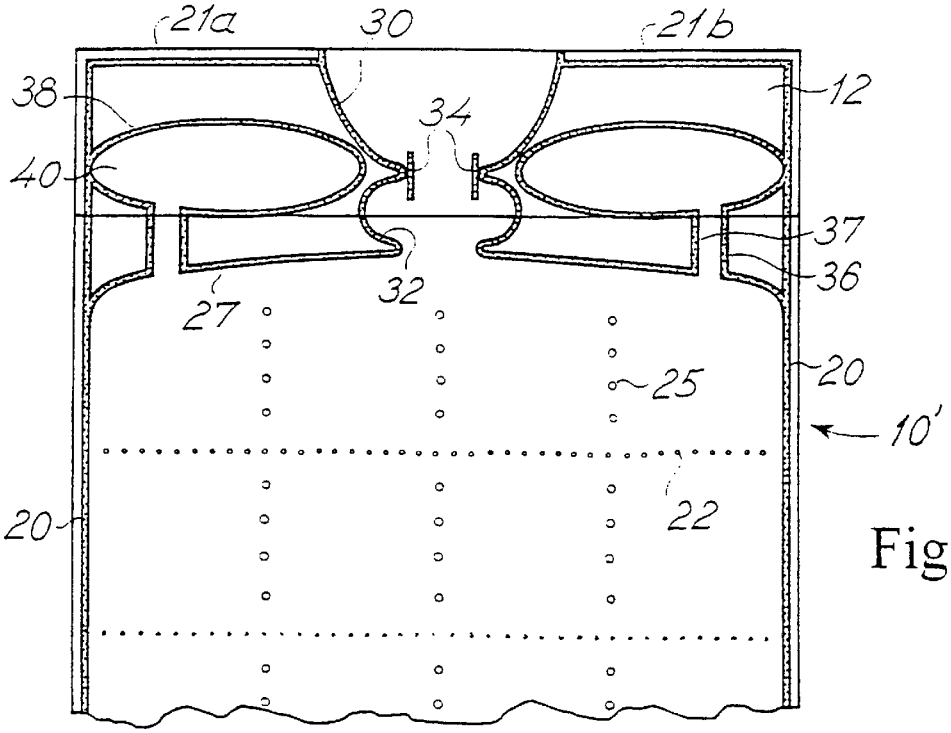
FIG. 5 is a schematically view corresponding to FIG. 1*a* of the upper part of a second embodiment of the ice cube bag according to the invention.

FIG. 5 is an illustration of a second embodiment of the ice cube bag according to the present invention. This second embodiment is designated in its entirety the reference numeral 10$^{i}$ and differs from the embodiment 10 described above with reference to FIGS. 1*a*, 1*b* and 2 of the drawing in that the line weldings 26 are omitted, in that a total of five crosswise or horizontal sets of weldings each consisting of thirty-nine point weldings 22 positioned in identical small mutual distances have instead been provided and that each of the perpendicular sets of point weldings consists of four point weldings 25. Thus, in accordance with the teachings of the present invention it has been realized that not only the specific size of a point welding in relation to the foil thickness and the specific foil material determine the tearing apart function, including the first perforation as described above with reference to FIG. 4*a* and FIGS. 4*b*, but also other factors, including the distance between the point weldings mutually and their distance to other weldings either line weldings or point weldings, are of importance to and decisive with respect to whether the point welding—after the interior of the ice cube bag has been filled with water and after the water has been frozen into ice cubes—may perform the perforation function illustrated in FIG. 4*a* as well as the tearing apart function illustrated in FIG. 4*b*.

Figure 6A:
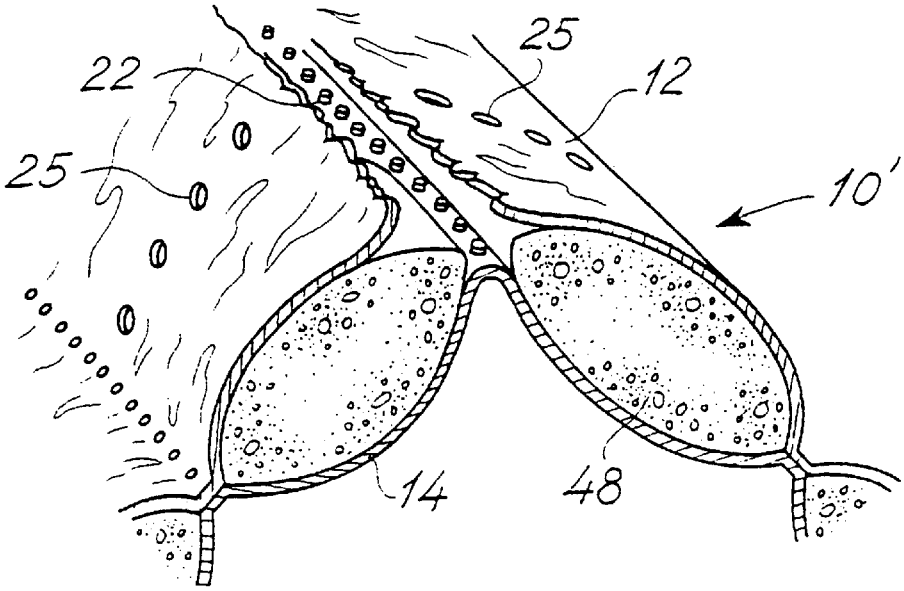
FIGS. 6*a* and 6*b* are illustrations corresponding to FIGS. 4*b* and 4*a*, respectively, of the result of a folding of the second embodiment of the ice cube bag according to the invention illustrated in FIG. 5, transversly relative to the longitudinal direction of the ice cube bag and longitudinally of the ice cube bag, respectively, for production of a tearing apart or ripping, respectively, of the ice cube bag and a damaging of the separations of the ice cubes confined in the ice cube bag.

In FIG. 5 the small distance between the relatively small point weldings 22 in the crosswise five sets of weldings 22 provides that a folding of the ice cube bag around a line through these relatively small point weldings 22 positioned in a small mutual distance will produce a tearing apart of the bag as illustrated in FIG. 6*a* and functionally corresponding to the above description with reference to FIG. 4*a* and 4*b*.

Figure 6B:
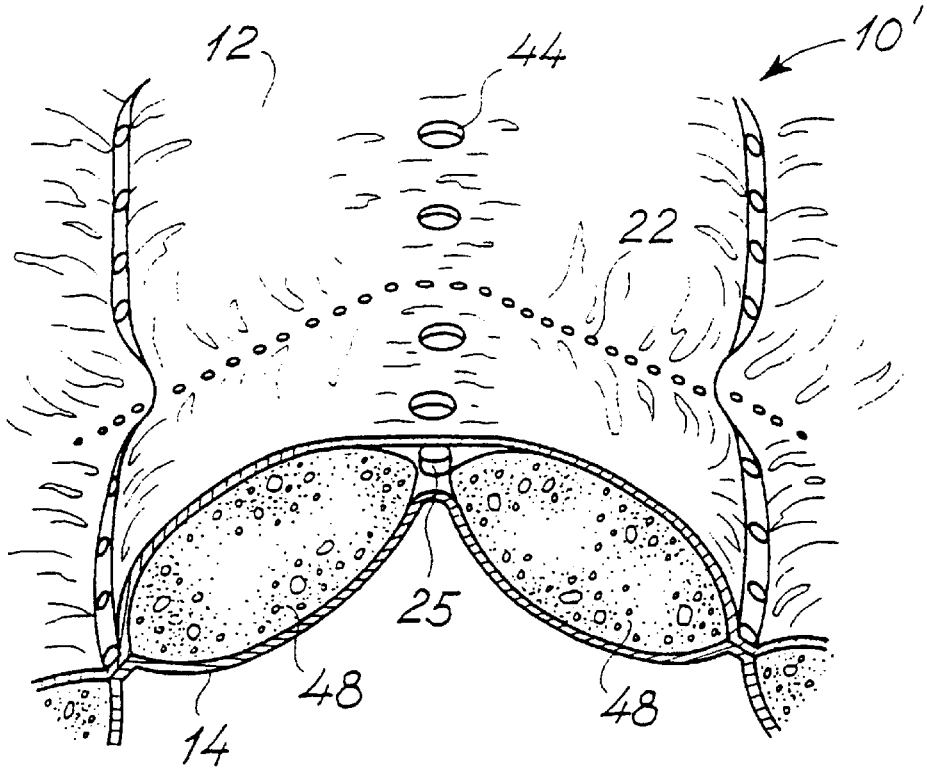

Correspondingly, the relatively big distance between the relatively big point weldings 25 in the perpendicular compartmentation of the ice cube bag 10' conditions that unless the bag is exposed to even extremely big foldings these point weldings 25 will only allow and make possible a perforation of the foil wall as illustrated in FIG. 6*b* corresponding to the above description with reference to FIG. 4*a*, allowing the ice cube bag 10' illustrated in FIG. 5 to be handled in such a manner that firstly the ice cube bag 10' is folded or bended in lines through the straight point weldings 25 causing these point weldings to be torn apart for generating perforations and eliminating of the perpendicular compartmentation whereafter a folding of the ice cube bag in a line through the point weldings 22 will tear apart the foil walls as illustrated in FIG. 6*a* and allow admission immediately to the eight detached ice cubes inside the tearing line.

Figure 7A:
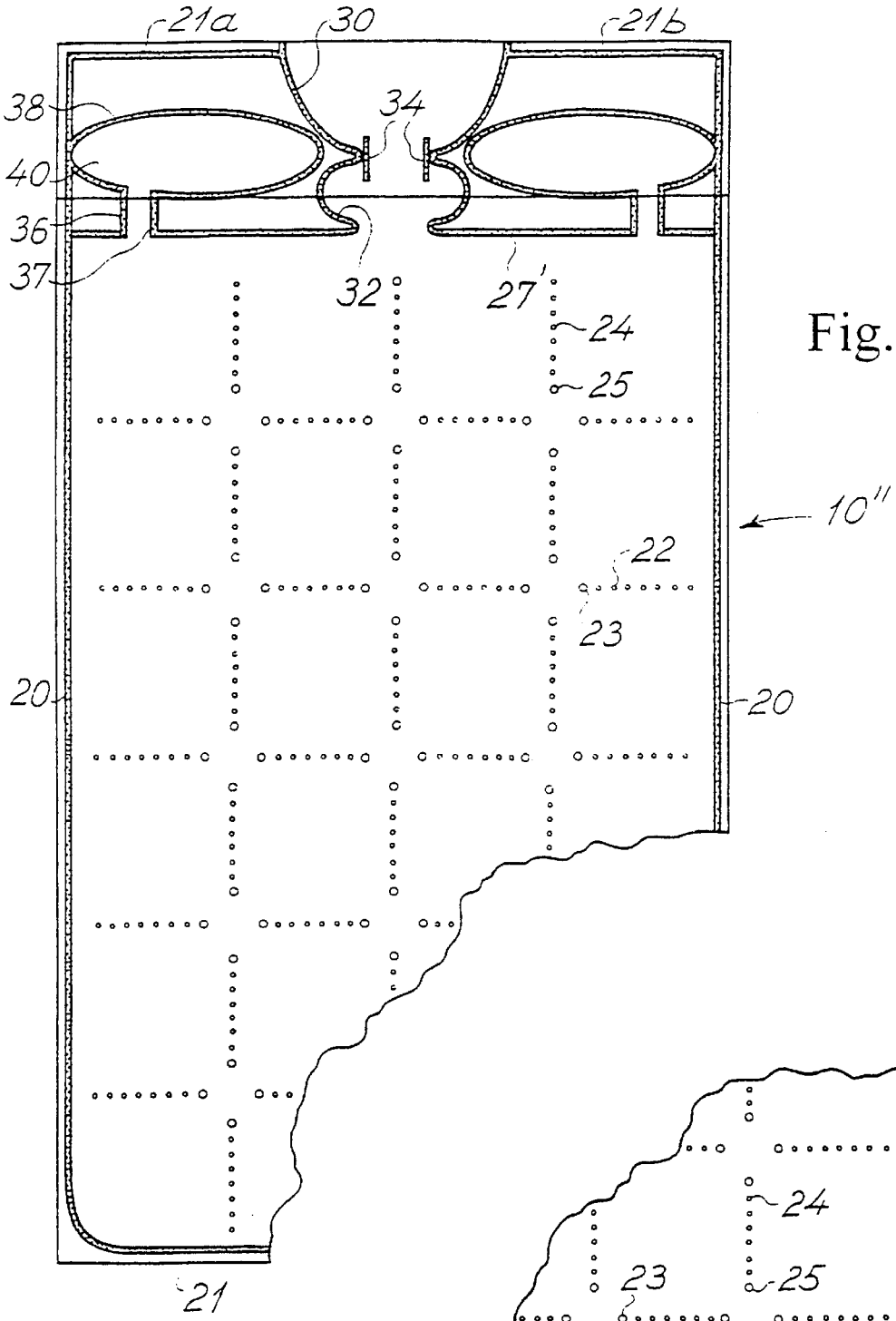
FIG. 7*a* is a schematic view corresponding to FIGS. 1*a* and FIG. 5 of a third embodiment of the ice cube bag according to the invention.

FIG. 7*a* is a third embodiment of the ice cube bag according to the present invention which third embodiment is designated in its entirety the reference numeral 10$^{ii}$. This third embodiment differs from the above first and preferred embodiment described with reference to FIG. 1*a*, 1*b* and 2 of the drawing in that the four horizontal line weldings 26 have been omitted and replaced by two further sets of horizontal point weldings corresponding to the three sets of horizontal point weldings described above with reference to FIG. 1*a* and produced in the three sub-compartments in the first embodiment illustrated in FIG. 1*a*. The third embodiment of the ice cube bag according to the present invention illustrated in FIG. 7*a* furthermore differs from the embodiment described with reference to FIG. 1*a* in that the number of point weldings in the sets of horizontal and perpendicular point weldings differs from the above described number. Thus, tests performed by the inventor has proved that also the number of point weldings may be of importance firstly to the pressure resistance of the ice cube bag as the distension of the foil in the individual ice cube compartments produces a largest force component or a largest pull in the middle of the side edge of the individual ice cube compartments. If, accordingly, a point welding is present in the middle of the side edge of an ice cube compartment, this point welding will be exposed to the greatest stress and therefore the pressure resistance of the ice cube bag may be increased by avoiding placing any point welding in this middle point and accordingly make the horizontal and the perpendicular point weldings in an even number, e.g. four, six or, as illustrated in FIG. 7*a*, eight point weldings in the sets of horizontal as well as perpendicular point weldings. Additionally, this third embodiment differs from the two embodiments previously described in that the outwardly sloping and diverging weldings 27 illustrated in FIGS. 1*a* and 5 have been replaced by rectilinear line weldings 27'.

The third embodiment illustrated in FIG. 7*a* may in accordance with the teachings of the present invention be handled in numerous alternative ways, the horizontal sets of point weldings enabling a tearing apart of the ice cube bag in a line through such a set, and the perpendicular sets of point weldings enabling a tearing of the bag in a perpendicular line through such a set of perpendicular point weldings. Alternatively, by twisting the ice cube bag as it will be described below with reference to FIG. 15, it is possible to produce a tearing apart of the point weldings without simultaneous tearing apart of the foils and thus a conversion of the compartmentalized ice cube bag into a non-compartmentalized ice cube bag, the individual point weldings in the horizontal as well as the perpendicular point weldings being thus solely exposed to a stress providing a perforation of one of the foil walls corresponding to the above description with reference to FIG. 4*a* of the drawing.

Figure 7B:
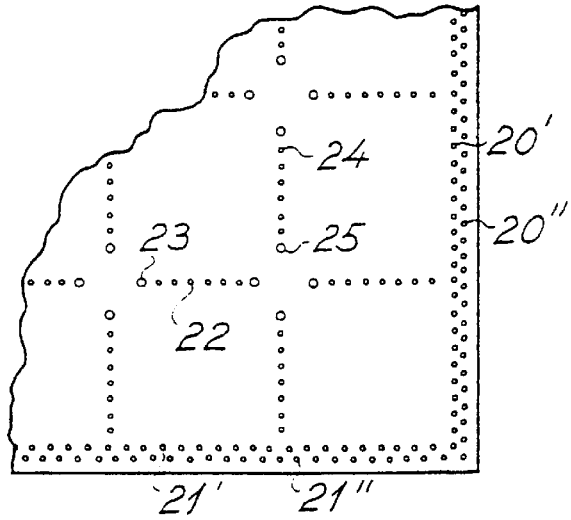
FIG. 7*b* is a schematic view of a detail of a modified side welding in relation to the embodiment of the ice cube bag according to the invention illustrated in FIG. 7*a,*

FIG. 7*b* is an illustration of a detail of the third modified embodiment of the ice cube bag according to the present invention in relation to the one described above with reference to FIG. 7*a*. The above described line weldings, i.e. the side weldings 20, the bottom welding 21, the top weldings 21*a* and 21*b* and the weldings 27', 30, 32, 34 and 38 may in accordance with the teachings of the invention be produced as uninterrupted line weldings or alternatively be produced as a combination of tightly positioned point weldings positioned in one line or several sets of lines as illustrated in FIG. 7*b*. FIG. 7*b* is an illustration of a lower right-hand corner of a modified embodiment of the third embodiment 10$^{ii}$ of the ice cube bag according to the present invention in which the side welding 20 and the bottom welding 21 have been replaced, each by two series of displaced point weldings of the same geometrical extension as the above described point weldings 22 and 24. Two point weldings in the inner and the outer rows, respectively, of these two series of point weldings, together constituting the side welding, are designated the reference numeral 20' and 20", respectively. These two series of point weldings displaced in relation to each other produce a distension of the foils when the ice cube bag is filled with water so that the foils are being pressed together and held tightly at the water pressures which are produced by the water column in the interior of the ice cube bag.

Figure 8:
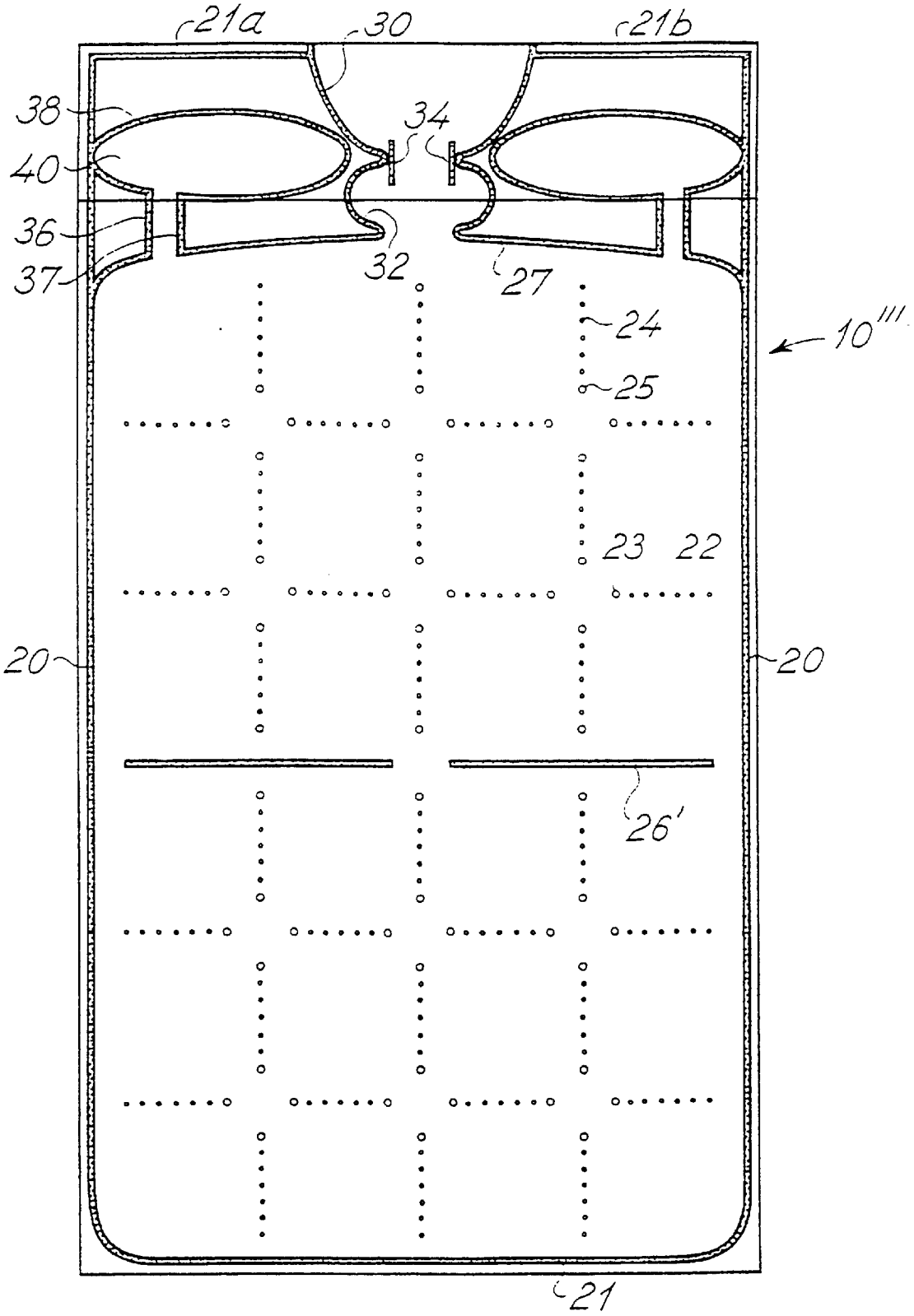
FIG. 8 is a schematic view corresponding to FIG. 1, FIG. 5 and FIG. 7*a* of a fourth embodiment of the ice cube bag according to the invention.

FIG. 8 is an illustration of a fourth embodiment of the ice cube bag according to the present invention which fourth embodiment is designated in its entirety the reference numeral 10$^{iii}$. This fourth embodiment of the ice cube bag according to the present invention differs from the above described first and the above described third embodiment in that centrally in the ice cube bag two line segment configurated cross weldings 26' are provided for obtaining a bipartition of the interior of the ice cube bag. Additionally, this fourth embodiment of the ice cube bag 10$^{iii}$ allows a handling of the ice cube bag after freezing of the ice cubes in accordance with the handling described with reference to FIG. 2 or alternatively the handling described above with reference to FIG. 7*a*, i.e. either a taking out by means of tearing out of ice cubes from one of the halves of the interior of the ice cube bag or an elimination of the compartmentation in one of the half compartments or both of the half compartments in the interior of the ice cube bag.

Figure 9:
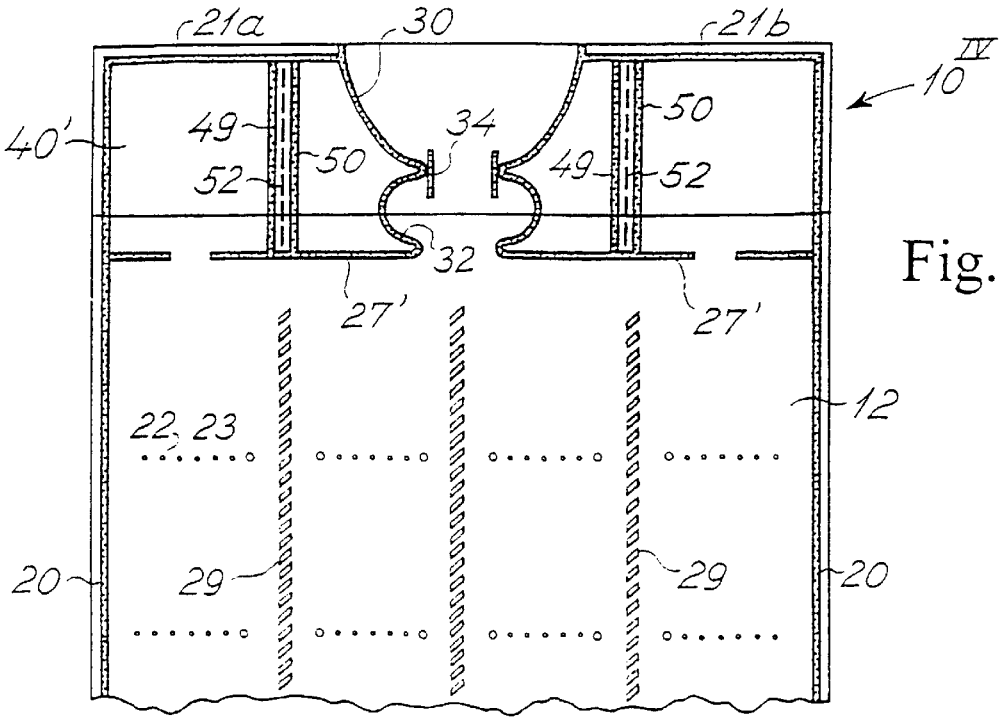
FIG. 9 is a schematic view corresponding to FIG. 1*a*, FIG. 5, FIG. 7*a* and FIG. 8 of a fifth embodiment of the ice cube bag according to the invention.

FIG. 9 is an illustration of a fifth embodiment of the ice cube bag according to the present invention. This fifth embodiment is designated in its entirety the reference numeral 10$^{iv}$. Like the previously described embodiments, the ice cube bag 10$^{iv}$ is a so-called self-closure bag and is constituted by the above described two foils 12 and 14 with associated folded parts 16 and 18. Correspondingly, the fifth embodiment illustrated in FIG. 9 constitutes the two side weldings 20, the bottom welding 21, the two top weldings 21*a* and 21*b* and the inlet channel defining welding sets 30, 32 and 34. Furthermore, the ice cube bag 10$^{iv}$ has two horizontal line weldings 27' corresponding to the extensions of the semicircular weldings 32 described above with reference to FIG. 7*a*, the weldings 27' being interrupted for generating two expansion chambers 40' on each side of the inlet channel. The ice cube compartments of the interior of the ice cube bag are divided into four column-shaped sub-compartments by means of three sets of perpendicular weldings 29 extending from positions above the bottom welding 21, not illustrated in FIG. 9, until positions immediately below the cross weldings 27' and each constituting of a large number of slopingly positioned line segment-shaped individual weldings in total constituting a line welding in accordance with the teachings of the present invention. The perpendicular weldings 29 may alternatively be constituted by point weldings or line segments. Like the previously described four embodiments, the ice cube bag 10$^{iv}$ is an ice cube bag for production of twenty-four ice cubes and each the four column-shaped sub-compartments are, accordingly, by means of four individual sets of horizontal point weldings 22 divided into six ice cube compartments. These sets of horizontal point weldings are produced and configurated identically with the horizontal point weldings 22 described above with reference to FIG. 1*a* in the first embodiment of the ice cube bag according to the invention illustrated in FIG. 1*a*.

The fifth embodiment $\mathbf{10}^{iv}$ is characterized by being provided with tearing apart instructions which are arranged as a perforation 52 extending from the top of the ice cube bag through the top weldings 21*a* and 21*b* and down to the weldings 27', these perforations being so to speak confined between the two sets of parallel line weldings 49 and 50 which at the same time serve the purpose of preventing water from the expansion chambers 40 from penetrating out through the perforations 52. The fifth embodiment of the ice cube bag according to the invention illustrated in FIG. 9 is filled in the same way as the above described four embodiments and is closed by utilizing the self-closure function described in the above mentioned European patent and the above mentioned European patent application.

Figure 10:
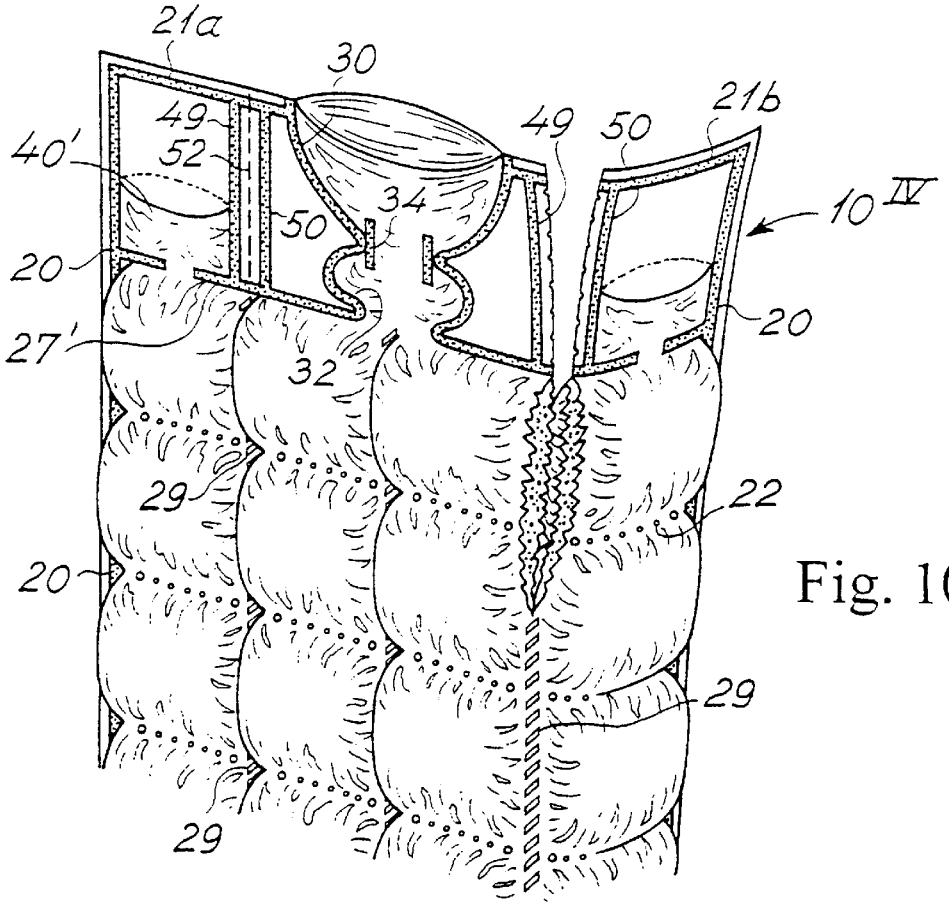
FIG. 10 is a schematic and perspective view of a process of tearing apart the fifth embodiment of the ice cube bag according to the invention illustrated in FIG. 9 after freezing of the water contained in the interior of the ice cube bag into ice cubes.

After freezing, the ice cube bag $\mathbf{10}^{iv}$ may immediately be torn apart as illustrated in FIG. 10, the ice cube bag being torn apart in the perforations 52 causing the tearing apart to continue down through the corresponding welding 29. Admission to the twelve ice cubes confined in one of the halves of the ice cube bag is obtained by tearing apart the ice cube bag in the one side, i.e. on the right-hand or the left-hand side of the inlet channel and further down through the welding 29 lying in continuation of the perforations 52. These twelve ice cubes may immediately be taken out by using the foil tearing technique as described above with reference to FIGS. 4*a* and 6*b* of the drawing for release of the individual ice cubes. It should be noted that this division of the individual ice cubes or separation of the ice cubes from each other by tearing apart one of the foils, e.g. the foil 12 as illustrated in FIGS. 4*a* and 6*b*, may instead be used for separating the individual ice cubes from each other before the ice cube bag is torn apart by use of the above described perforations 52.

Figure 11:
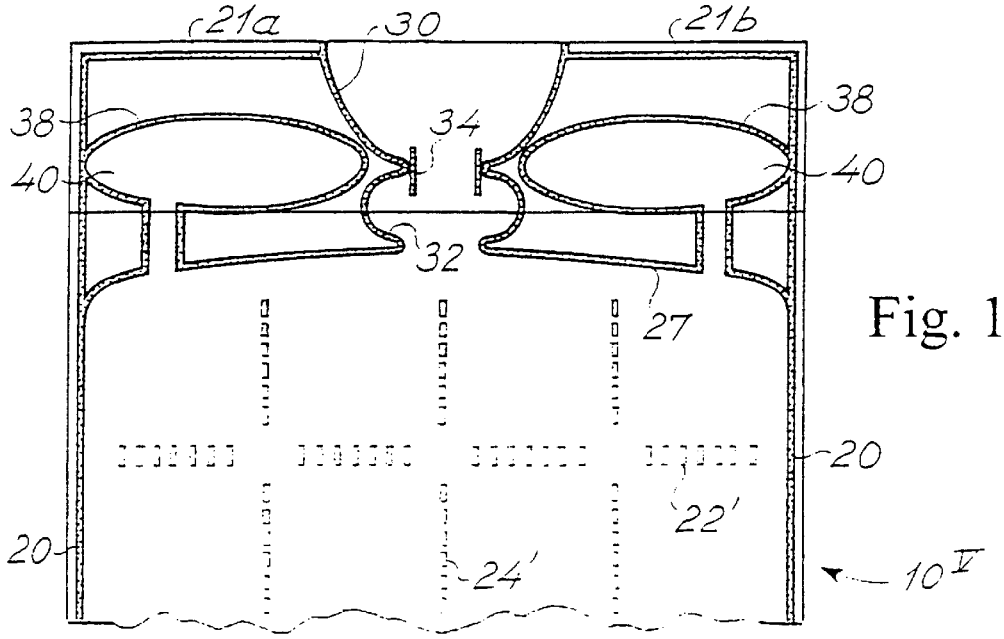
FIG. 11 is a schematic and perspective view corresponding to FIG. 1, FIG. 5, FIG. 7*a*, FIG. 8 and FIG. 9 of a sixth embodiment of the ice cube bag according to the invention.

FIG. 11 is an illustration of the sixth embodiment of the ice cube bag according to the present invention designated in its entirety the reference numeral $\mathbf{10}^{v}$. This embodiment substantially corresponds to the third embodiment $\mathbf{10}^{iii}$ described above with reference to FIG. 7*a* of the drawing, the point weldings 22, 23, 24 and 25 in the sixth embodiment $\mathbf{10}^{v}$ illustrated in FIG. 11 having been replaced by small rectangular weldings having substantially the same area extension as the above described point weldings 22 and 24. The compartmentalized weldings in the ice cube bag $\mathbf{10}^{v}$ comprises sets of rectangular-configurated weldings 22' positioned in a horizontal line with the longitudinal axis of the individual rectangle perpendicular on the horizontal line in question. The weldings in the perpendicular ice cube compartments in the ice cube bag $\mathbf{10}^{v}$ are, on the contrary, positioned with the individual rectangles in the rectangle-configurated weldings 24' positioned in accordance with the direction of the compartmentation line, i.e. with the individual rectangular-configurated weldings 24' in continuation of each other. In accordance with the teachings of the invention, this different orientation of the rectangle-configurated weldings 22' and 24' provides, corresponding to the above description with reference to FIG. 5 of the drawing, a difference in the tendency to enable a tearing apart in accordance with the rectangle-configurated weldings, the ice cube bag $\mathbf{10}^{v}$ illustrated in FIG. 11 demonstrating larger tendency to be able to be torn apart according to the perpendicular rectangle-configurated weldings 24' positioned in continuation of each other and thus having a smaller mutual distance than the horizontal rectangle-configurated weldings 22', preferably constituting instructions for elimination of the compartmentation of the ice cube bag in accordance with the technique described above with reference to FIG. 4*a* and 6 of the drawing.

Figure 12:
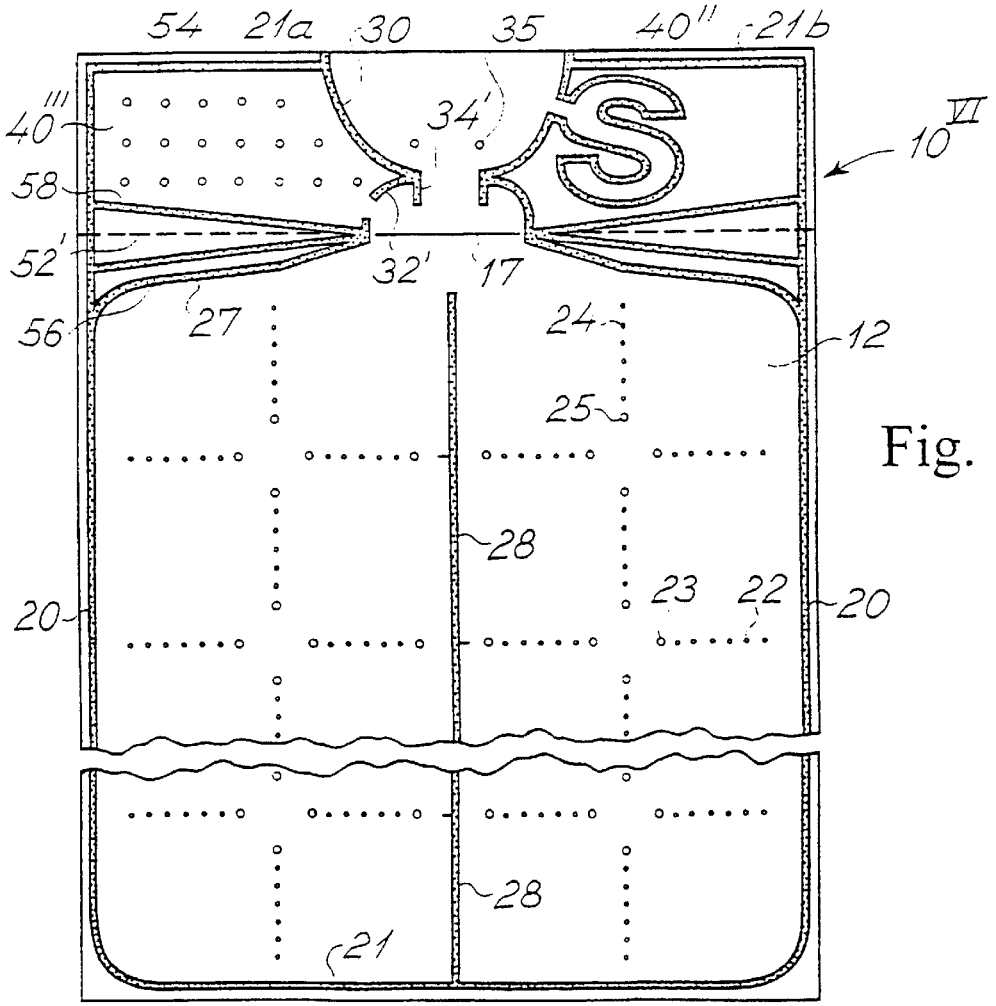
FIG. 12 is a schematic and perspective view corresponding to FIG. 1*a*, FIG. 5, FIG. 7*a*, FIG. 8, FIG. 9 and FIG. 11 of a seventh embodiment of the ice cube bag according to the invention.
Figure 13:
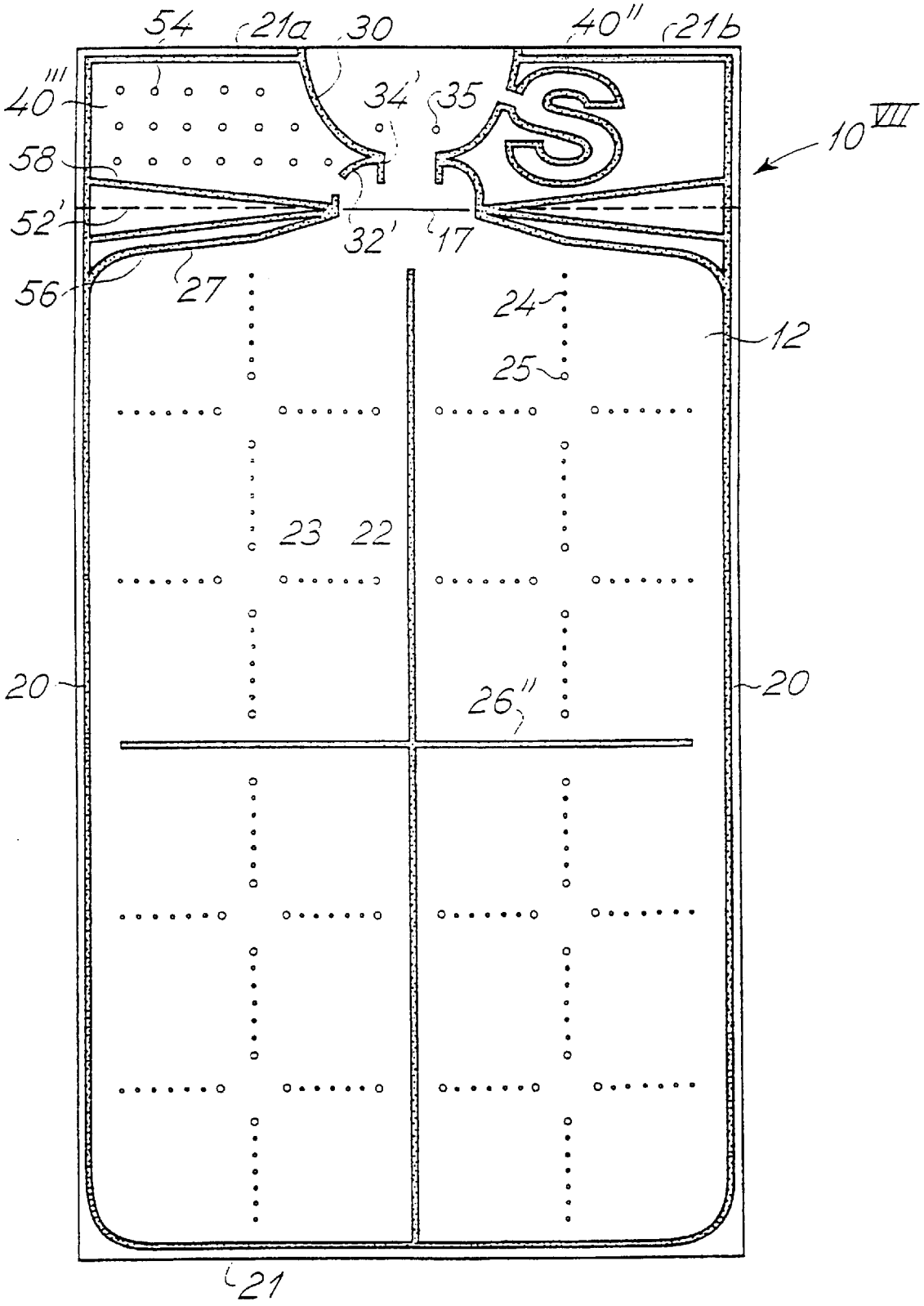
FIG. 13 is a schematic view corresponding to FIG. 1*a*, FIG. 5, FIG. 7*a*, FIG. 8, FIG. 9, FIG. 11 and FIG. 12 of an eighth embodiment of the ice cube bag according to the invention.

FIGS. 12 and 13 are illustrations of a seventh and an eighth embodiment, respectively, of the ice cube bag according to the present invention designated the reference numerals $\mathbf{10}^{vi}$ and $\mathbf{10}^{vii}$, respectively. Like the above described embodiments these two embodiments are produced from the above described foils 12 and 14 and assembled by means of the side weldings 20, the bottom welding 21 and the two top weldings 21*a* and 21*b* already described. The two ice cube bags $\mathbf{10}^{vi}$ and $\mathbf{10}^{vii}$ are provided with the two above described outwardly sloping and diverging weldings 27, however, unlike the embodiments described above these are not provided with breakouts.

The inner compartmentalized ice cube compartments in the seventh and the eighth embodiments, $\mathbf{10}^{vi}$ and $\mathbf{10}^{vii}$, respectively, is by the way produced substantially in accordance with the compartmentation illustrated in FIG. 7*a* of the drawing with horizontal and perpendicular point weldings 22, 23 and 24, 25, respectively, the seventh embodiment illustrated in FIG. 12 being produced with a single central perpendicular line welding 28, whereas the eighth embodiment $\mathbf{10}^{vii}$ illustrated in FIG. 13 is besides the central perpendicular line welding 28 provided with a horizontal line welding 26" crossing the perpendicular line welding 28, but without being in connection with the side weldings 20 and thus establishing connection from the upper half of the inner ice cube compartment, i.e. the half of the inner ice cube compartment positioned above the line weldings 26" to the lower half provided below the line welding 26".

The inlet parts in the seventh and eighth embodiments of the ice cube bag according to the present invention illustrated in FIGS. 12 and 13 of the drawing, respectively, are provided with an inlet channel of a configuration substantially corresponding to the inlet channel configuration described above with reference to FIG. 1*a* of the drawing. The inlet channel in the ice cube bags $\mathbf{10}^{vi}$ and $\mathbf{10}^{vii}$ is thus defined by two weldings 30 converging from the inlet channel towards the inner ice cube compartment of the ice cube bag, extending into two quadrant-configurated weldings 32' at the constriction defined by these weldings. In the constriction two rectilinear weldings 34' are, furthermore, provided which compared to the above described rectilinear weldings 34 illustrated in FIG. 1*a* only extend inwardly from the constriction towards the inner ice cube compartment of the ice cube bag. Above the constriction, two point weldings 35 are provided serving the purpose of keeping the foils together in the inlet channel. In the two embodiments $\mathbf{10}^{vi}$ and $\mathbf{10}^{vii}$ illustrated in FIGS. 12 and 13 of the drawing, respectively, the right-hand welding 30 is broken for establishment of connection with an S-shaped chamber 40" serving the purpose of producing an expansion chamber corresponding to the above described expansion chambers 40. Similarly, the left-hand quadrant-configurated welding 32' is broken for establishment of connection with another expansion chamber 40'", in which a number of point weldings 54 is similarly provided for limitation of the volume of the quantity of liquid which may expand into this expansion chamber.

The embodiments $\mathbf{10}^{vi}$ and $\mathbf{10}^{vii}$ illustrated in FIGS. 12 and 13, respectively, are moreover adapted to be torn apart by tearing away the inlet channel of the ice cube bag after that the water contained in the ice cube bag is frozen into ice. Corresponding to the above described perforations 52, for this tearing apart function perforations 52' have been provided extending from the side weldings 20 inwardly towards the quadrant-configurated weldings 32', the perforations not extending past these line weldings, and similarly, for limitation of the perforations 52' corresponding to the line weldings 49 and 50 illustrated in FIG. 9, line weldings 56 and 58 are provided connecting the line weldings 20 with the quadrant-configurated weldings 32' and furthermore reinforcing the foil material behind or immediately abutting on the perforations 52'.

The self-closure bags illustrated in FIGS. 12 and 13 are filled with water and closed in the above described manner and more detailed as described in the above mentioned European patent and above mentioned published European patent application whereafter the water contained in the inner ice cube compartments of the ice cube bag in question is brought to freeze by the ice cube bag in question being positioned in a deep freezer, a freeze locker or in another room cooled down to below the freezing point. After the water in the individual ice cube compartments has frozen into ice cubes, the entire inlet part, i.e. the area above the perforations 52' in the ice cube bags $\mathbf{10}^{vi}$ and $\mathbf{10}^{vii}$ may be torn apart for allowing admission to the ice cubes contained in the interior of the ice cube bag through the thus torn apart second segment of the inlet channel, the individual ice cubes being able to be manipulated and taken out from the ice cube bag by utilizing the foil separation and foil tearing apart features which are conditioned on the horizontal and perpendicular point-configurated weldings in the inner compartmentalized ice cube compartments of the ice cube bag.

All the the above described eight embodiments are so-called self-closure bags and are furthermore bags for production of 24 ice cubes. However, it should be pointed out that the teaching of the present invention is not limited to self-closure bags and is not, either, limited to a specific number of ice cubes, as in an ice cube bag implemented in accordance with the teachings of the present invention an arbitrary number of ice cube compartments may be arranged for, in a number smaller or bigger than 24, e.g. 12, 16, 18, 30 and 36 etc. Correspondingly, the inlet part of the ice cube bag may be produced without the self-closure function, for example with a funnel-shaped part for closing by means of a knot closure or alternatively by means of a knot closure of the type described in U.S. Pat. No. Re. 31.890, to which reference is made and which US patent is hereby incorporated in the present specification by reference. Furthermore, it should be noted that a combination of a self-closure bag and a knot bag may be realized by combining e.g. the technical principles described in the above mentioned US patent and the technical principles stated in the above mentioned European patent and the above mentioned European patent application. By combining the self-closure and the knot closure in an ice cube bag, the special advantage may be obtained that in the self-closure bag it becomes possible to increase the liquid inner pressure when producing the knot closure.

Figure 14:
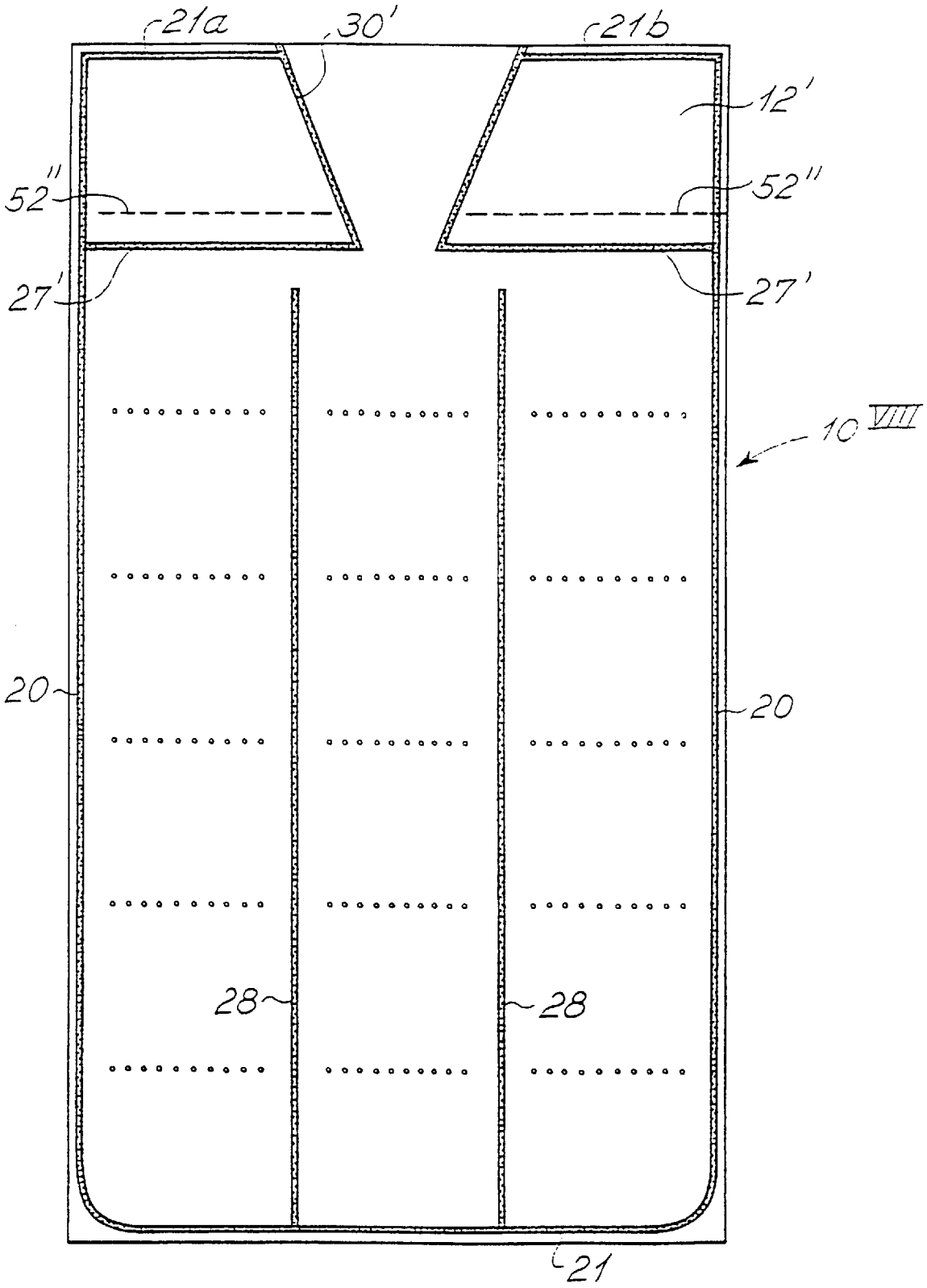
FIG. 14 is a schematic and perspective view corresponding to FIG. 1*a*, FIG. 5, FIG. 7*a*, FIG. 8, FIG. 9, FIG. 11, FIG. 12 and FIG. 13 of a ninth embodiment of the ice cube bag according to the invention which ninth embodiment differs from the preceding eight embodiments by not being a self-closure ice cube bag, but an ice cube bag having a knot closure.

FIG. 14 is an illustration of a ninth embodiment of the ice cube bag according to the present invention which embodiment is designated in its entirety the reference numeral $\mathbf{10}^{viii}$. This ice cube bag differs from the above described ice cube bags in that the ice cube bag constitutes a knot bag, i.e. an ice cube bag, which unlike the above described self-closure bags is closed by tying a knot by means of flaps provided in the inlet channel of the ice cube bags in accordance with the technical teachings described in the above mentioned US patent. Thus, the ice cube bag $\mathbf{10}^{viii}$ is, unlike the above described self-closure bags, produced from two foils of which only one, i.e. the uppermost positioned foil designated the reference numeral 12', is not provided with folded parts corresponding to the above described folded parts 16 and 18 illustrated in FIG. 14. The foils in the ice cube bag $\mathbf{10}^{viii}$ are welded together by means of the two side weldings 20, the bottom welding 21 and the two top weldings 21*a* and 21*b*. The interior of the ice cube bag is, moreover, limited to the two rectilinear weldings 27' which unlike the rectilinear weldings 27' illustrated in FIG. 7*a* are not broken for establishment of an expansion chamber. On the contrary, the rectilinear weldings 27' connect the side weldings 20 with two rectilinear weldings 30' connecting the top weldings 21*a* and 21*b* with the above mentioned rectilinear weldings 27'. Above the rectilinear weldings 27', cuts designated the reference numeral 52" or perforations corresponding to the perforations 52' illustrated in FIGS. 12 and 13 and extending until immediately before the inwardly converging, rectilinear weldings 30' together constituting a funnel-shaped inlet channel are made from the sides of the ice cube bag. The ice cube compartment of the ice cube bag illustrated in FIG. 14 is divided into three perpendicular sub-compartments by means of two perpendicular line weldings 28 corresponding to the perpendicular line weldings 28 described above with reference to FIGS. 12 and 13 of the drawing. Each of the individual three column configurated sub-compartments in the ice cube bag $\mathbf{10}^{viii}$ are, moreover, divided into six ice cube compartments by means of sets of horizontal point weldings, each set containing in total ten point weldings 22.

Thus, the ice cube bag $\mathbf{10}^{viii}$ illustrated in FIG. 14 serves the purpose of producing 18 ice cubes which for the same outer dimensions of the foils as for the above described embodiments condition the production of larger ice cubes. The ice cube bag $\mathbf{10}^{viii}$ is used in the following way. Water is poured through the funnel constituted by the rectilinear weldings 30' thereby filling the three column-configurated sub-compartments with water. After tearing the perforations 52", two flap-configurated parts are produced at the upper end of the ice cube bag, and these flap-configurated parts are tied into a knot for closing the interior of the ice cube bag. The ice cube bag is frozen for production of ice cubes whereafter, in accordance with the teachings of the invention, the compartmentalized ice cube compartments of the interior of the ice cube bag may be converted into a non-compartmentalized ice cube compartment and are furthermore advantageously torn by means of the point weldings 22 characteristic of the present invention.

The perpendicular line weldings illustrated may instead be replaced by point weldings, e.g. corresponding to the above described point weldings 25.

Furthermore, the ice cube bag $\mathbf{10}^{viii}$ illustrated in FIG. 14 may immediately be modified into a self-closing ice cube bag by replacing the foil 12' and correspondingly the foil lying behind by the foils 12 and 14 described above, the folded parts of these foils being brought to protrude down to a position opposite the perforations 52" which are omitted. At the same time, the inlet funnel 30' may be modified into another configuration e.g. by replacing the inlet funnel 30' by a two part inlet funnel with the outermost or first inlet part with the same sloping configuration as the funnel configuration illustrated in FIG. 14 and by another inlet part produced with perpendicular or slightly inwardly or outwardly sloping weldings.

Figure 15:
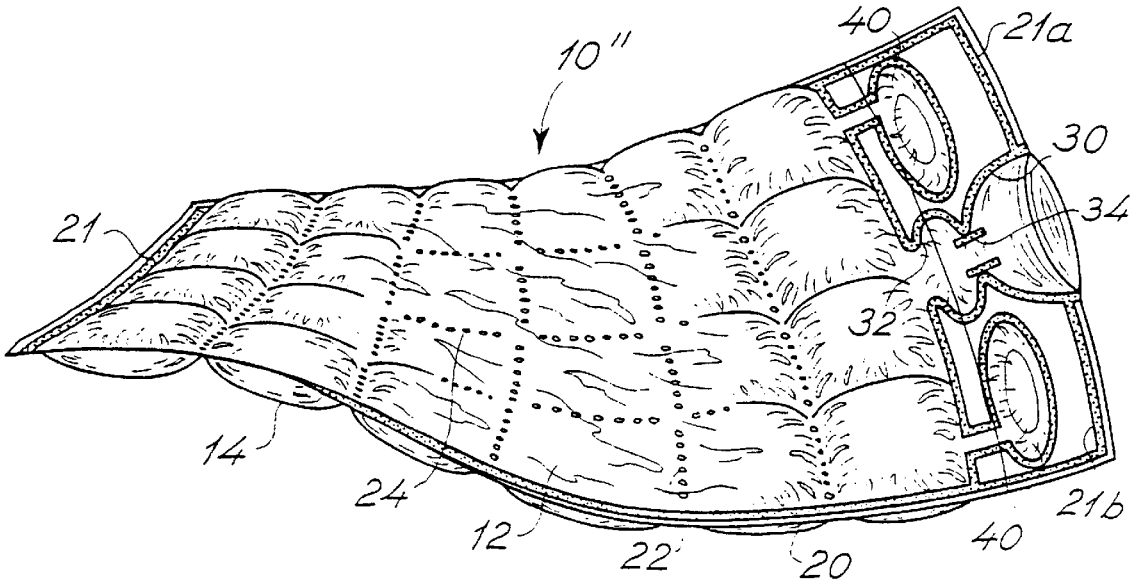
FIG. 15 is a schematic and perspective view of the third embodiment of the ice cube bag according to the invention illustrated in FIG. 7*a* after having been filled with water and after freezing, whereafter by means of physical manipulation corresponding to the processes illustrated in FIGS. 6*a* and 6*b* the ice cube bag may be torn apart or alternatively be converted into a non-compartmentalized bag.

As previously mentioned, FIG. 15 is an illustration of the third embodiment $\mathbf{10}^{ii}$ illustrated in FIG. 3 after ice cubes having been frozen in this ice cube bag as hereafter, the ice cube bag when being manipulated, i.e. twisted, folded or a combination thereof, may either be converted into a non-compartmentalized ice cube bag or alternatively torn apart by use of the tearing apart technique characteristic of the present invention, utilizing the tearing apart directions produced by the point weldings 22, 23, 24 and 25 characteristic of the present invention. The inlet part or filling part illustrated in the right-hand side of FIG. 15 may after freezing advantageously be used for maintaining the ice cube bag and thus for handling of the ice cube bag and may, moreover, as described above with reference to FIGS. 12 and 13 advantageously be used for tearing away the top or filling part of the ice cube bag in connection with taking out ice cubes or ice lumps from the interior of the ice cube bag.

Figure 16:
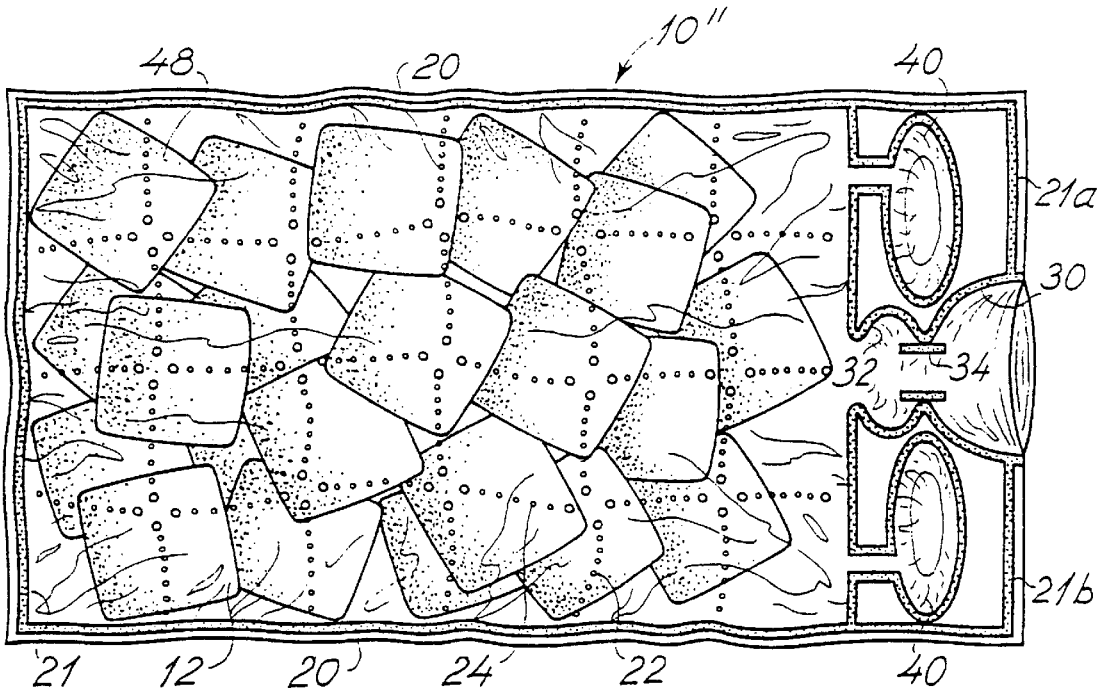
FIG. 16 is a schematic and perspective view of the third embodiment of the ice cube bag according to the invention illustrated in FIG. 7*a* after the ice cube bag as schematically illustrated in FIG. 15 has been converted into a non-compartmentalized bag with ice cubes lying freely in the interior of the bag.

FIG. 16 is an illustration of the third embodiment $\mathbf{10}^{ii}$ also illustrated in FIGS. 3 and 15 of the drawing after the ice cube bag during the manipulation described above with reference to FIG. 15 has been converted from a compartmentalized into a non-compartmentalized ice cube bag. In FIG. 16, the bag is illustrated lying on a plane support, e.g. a tabletop, perforations 44 in the foil 12 being provided in the right-hand part or half of the inner chamber of the ice cube bag as described above, whereas correspondingly in the left-hand part or half of FIG. 16 perforations in the opposite foil are provided by means of turning or twisting the foil in the opposite direction in the left-hand half compared to the right-hand part or half. The point weldings 22 and 24 illustrated in the left-hand part or half of the ice cube bag $\mathbf{10}^{ii}$ thus contain material tearings from the opposite foil in which perforations have correspondingly been provided corresponding to perforations 44 illustrated in the foil 12 in the right-hand half of the interior of the ice cube bag.

Figure 17:
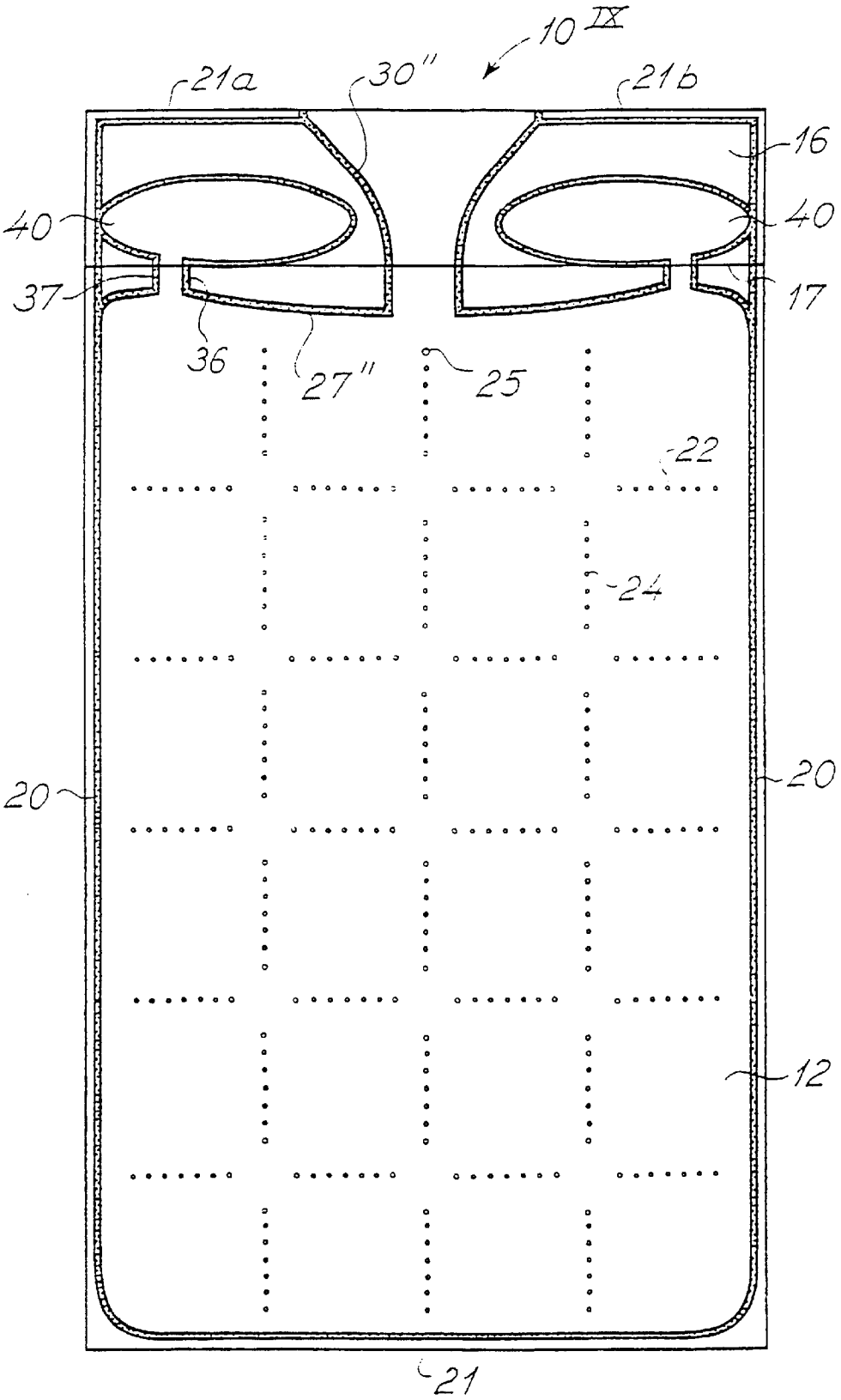
FIG. 17 is a schematic and perspective view corresponding to FIG. 1*a*, FIG. 5, FIG. 7*a*, FIG. 8, FIG. 9, FIG. 11, FIG. 12, FIG. 13 and FIG. 14 of a tenth embodiment of the ice cube bag according to the present invention.

FIG. 17 is an illustration of a tenth embodiment of the ice cube bag according to the present invention which tenth embodiment is designated in its entirety designated the reference numeral $\mathbf{10}^{ix}$. This tenth embodiment of the ice cube bag is to a great extent similar to the third embodiment of the ice cube bag according to the invention illustrated in FIG. 7*a* and constitutes a self-closure bag. The tenth embodiment is composed of the two foils 12 and 14 described above of which only the foil 12 is illustrated in FIG. 17, these foils being welded together by means of the side weldings 20, the bottom welding 21 and the two weldings 21*a* and 21*b*. From the top weldings 21*a* and 21*b*, two weldings 30" arcuating inwardly towards the interior of the channel extend towards the interior of the ice cube bag continuing in upwardly sloping side weldings 27" corresponding to the downwardly sloping side weldings 27 illustrated in FIG. 7*a*. Like the side weldings 27, the upwardly sloping side weldings 27" are broken for establishment of connection through the weldings 36 and 37 to the expansion chambers 40. The interior ice cube compartment of the ice cube bag $\mathbf{10}^{ix}$ is divided into twenty-four individual ice cube compartments by means of the above described point weldings 22 and 24 characteristic of the present invention. As is evident from FIG. 17, the upper point welding in the middlemost row of perpendicular point weldings is provided as a bigger point welding 25, this upper point welding positioned immediately below the inlet channel being exposed to the largest water pressure of all the point weldings during filling of the ice cube bag. The inlet channel configuration illustrated in FIG. 17 serves the purpose of accelerating the filling compared to the inlet channels described and illustrated above.

Figure 18:
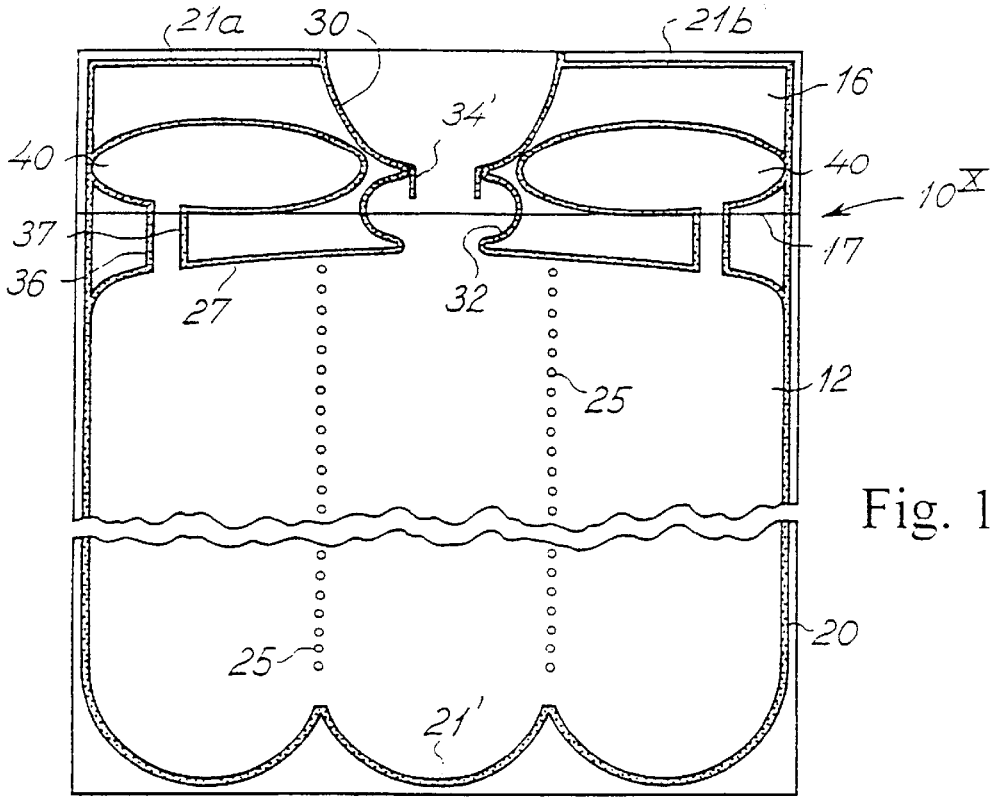
FIG. 18 is a schematic and perspective view corresponding to FIG. 1*a*, FIG. 5, FIG. 7*a*, FIG. 8, FIG. 9, FIG. 11, FIG. 12, FIG. 13, FIG. 14 and FIG. 17 of an eleventh embodiment of the ice cube bag according to the present invention.

FIG. 18 is an illustration of an eleventh embodiment of the ice cube bag according to the present invention which eleventh embodiment is designated in its entirety the reference numeral $\mathbf{10}^{x}$. This eleventh embodiment demonstrates a number of the features previously described with reference to FIGS. 1–17 of the drawing, this eleventh embodiment constituting a self-closure bag like several of the above described embodiments with side weldings 20, a modified bottom welding 21' composed of three semicircular parts corresponding to a compartmentation of the interior of the ice cube bag in three sub-compartments and top weldings 21*a* and 21*b*. The inlet channel of the ice cube bag is produced corresponding to the inlet channel described above with reference to FIG. 1*a* of the drawing, however modified by the perpendicular line weldings 34 being replaced by the line weldings 34' illustrated in FIG. 12 and 13 of the drawing. In addition, this eleventh embodiment demonstrates the same, downwardly sloping side weldings 27 as described above with associated perforations for establishment of connection with the expansion chambers 40 through the channels defined by the line weldings 36 and 37. The inner ice cube chamber of the ice cube bag is divided into three individual ice cube compartments being delimited by three sets of perpendicular point weldings, each containing a large number of point weldings 25, e.g. eighty-four point weldings. Accordingly, by means of this eleventh embodiment three big ice cubes or ice lumps may be produced which may be taken out in accordance with the tearing apart technique characteristic of the invention by means of point weldings 25 as described above.

Figure 19A:
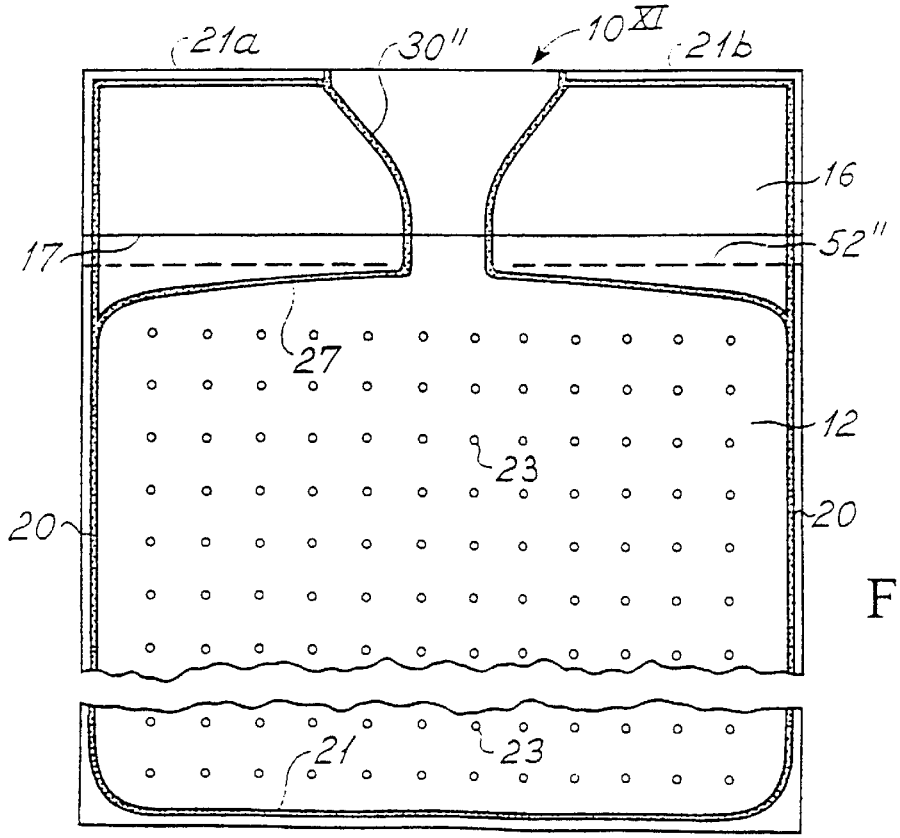
FIGS. 19*a* and 19*b* are schematic and perspective views corresponding to FIG. 18 of the twelfth and thirteenth embodiments of the ice cube bag according to the invention, respectively.
Figure 19B:
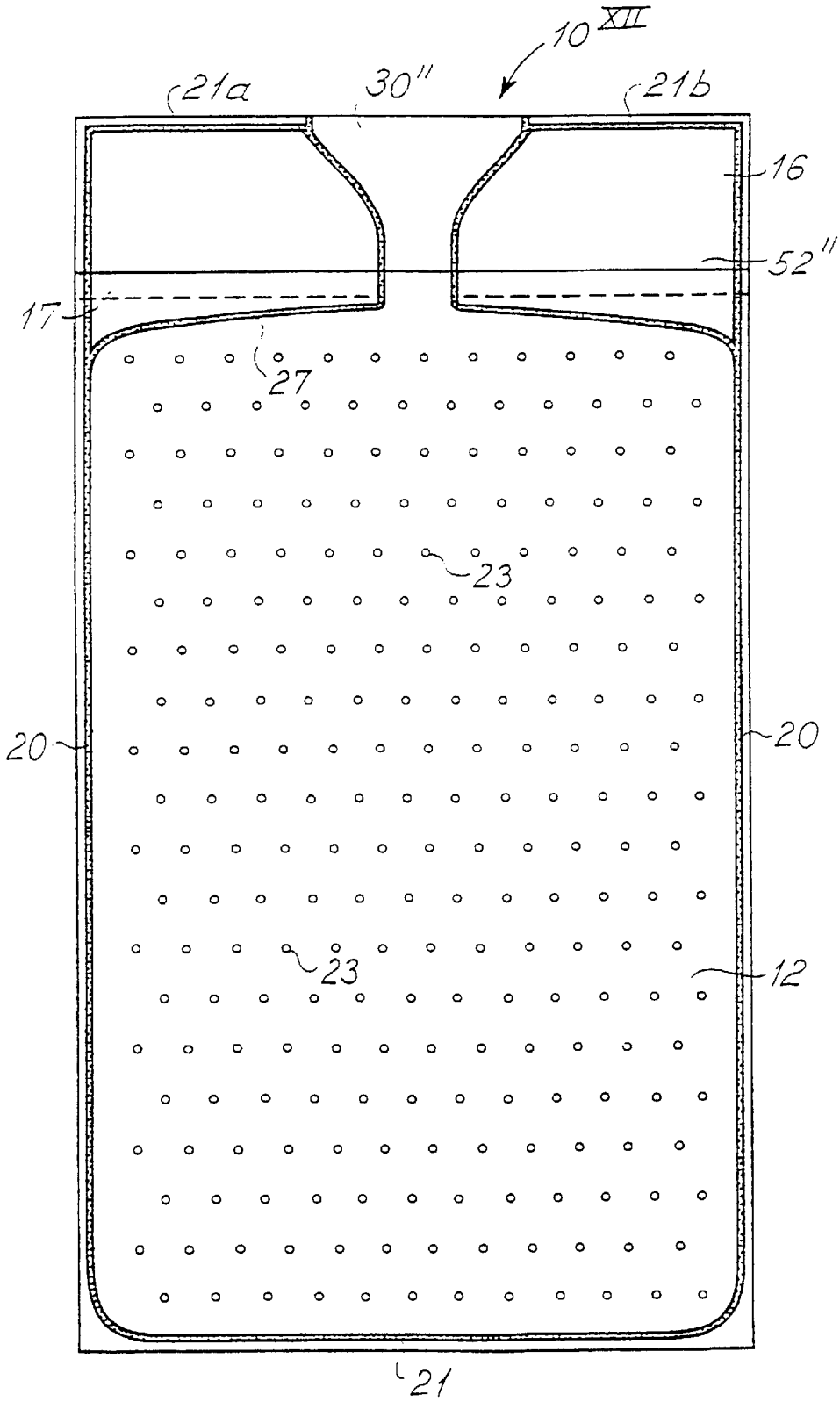

Furthermore, the teachings of the present invention makes it possible to provide ice cube bags with a very large number of individual ice cube compartments, like it is evident from FIGS. 19*a* and 19*b* illustrating a twelfth and a thirteenth embodiment, respectively, of the present invention, designated the reference numerals $\mathbf{10}^{xi}$ and $\mathbf{10}^{xii}$, respectively. Both of these two embodiments $\mathbf{10}^{xi}$ and $\mathbf{10}^{xii}$ constitute self-closure bags delimited by the side weldings 20, the bottom welding 21 and the top weldings 21*a* and 21*b*. Furthermore, the two embodiments $\mathbf{10}^{xi}$ and $\mathbf{10}^{xii}$ are produced with an inlet filling channel corresponding to the one described above with reference to FIG. 17 of the drawing constituting two inwardly towards the interior of the channel arcuating weldings 30", continuing directly into downwardly sloping side weldings 27 described above with reference to FIG. 1*a* of the drawing. Perforation lines 52" are provided under the edges 17 and 19, respectively, defined by the folded foil parts 16 and 18 (in FIG. 17 only one of the folded parts 16 with associated edge 17 is illustrated) either for establishment of a knot closure as stated above, i.e. a combined self-closure and knot-closure of the interior of the ice cube bag or alternatively for tearing of the top part of the ice cube bag after freezing of the water column contained in the interior of the ice cube bag. The two ice cube bags $\mathbf{10}^{xi}$ and $\mathbf{10}^{xii}$ are divided into a large number of individual ice cube compartments, only delimited by corner point weldings implemented in accordance with the teaching of the invention and of the same configuration as described above with reference to FIG. 1*a* of the drawing and designated the reference numeral 23. In FIG. 19*a*, the point weldings 23 are arranged in the corners or the corner points of an orthogonal pattern, whereas the point weldings 23 in the thirteenth embodiment $\mathbf{10}^{xii}$ illustrated in FIG. 19 are positioned in a pattern in which the point weldings positioned in horizontal lines in every second line are displaced half a raster or point welding distance to the one side, causing the ice cubes or ice lumps produced in the ice cube bag illustrated in FIG. 19*b* to be of diamond configuration whereas the ice cubes or ice lumps produced in the ice cube bag illustrated in FIG. 19*a* will be of substantially square configuration. An even extremely large number of individual ice cubes or ice lumps may be produced by means of the embodiments illustrated in FIGS. 19*a* and 19*b* of the drawing, in the embodiments illustrated more than two-hundred individual ice cubes or ice lumps.

Figure 20A:
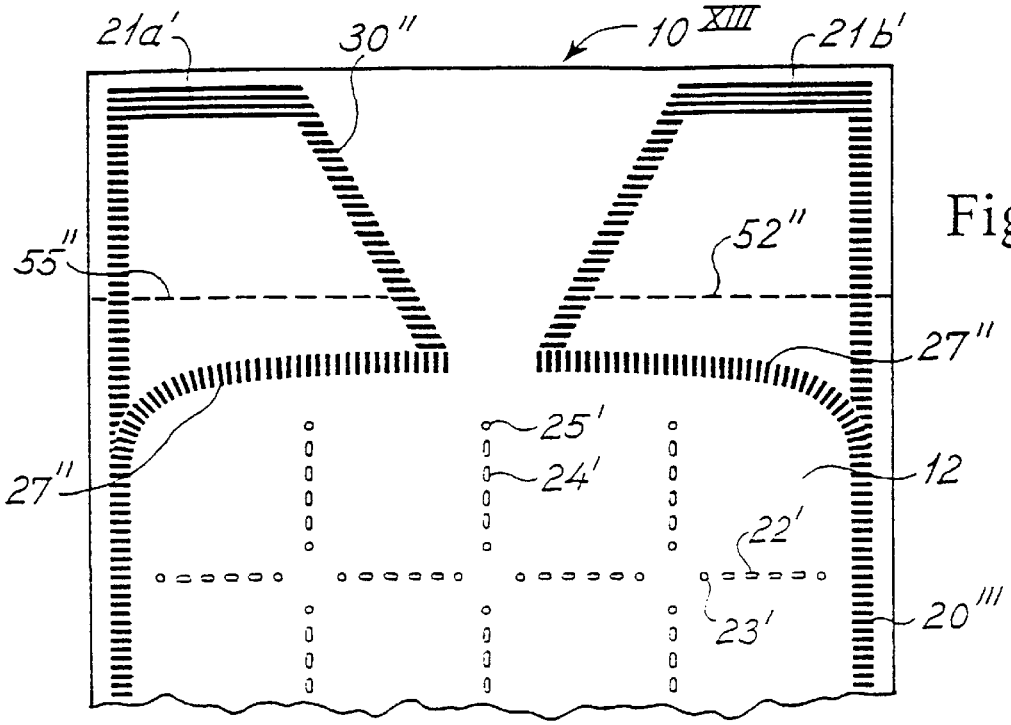
FIGS. 20*a*, 20*b*, 20*c* and 20*d* are schematic and perspective views corresponding to FIGS. 1*a*, 5, 7*a*, 8, 9, 11, 12, 13, 14, 17 and 18, of a fourteenth, a fifteenth, a sixteenth and a seventeenth embodiment, respectively, of the ice cube bag according to the present invention.

FIG. 20*a* is an illustration of a fourteenth embodiment of the ice cube bag according to the present invention which fourteenth embodiment is designated in its entirety the reference numeral 10x$^{iii}$. This fourteenth embodiment constitutes a knot bag of the same type as illustrated and described above with reference to FIGS. 14, 19*a* and 19*b* and additionally constitutes an embodiment which is—like the section of a modification of the third embodiment of FIG. 7*a* illustrated in FIG. 7*b*—produced by means of point and line segment weldings, exclusively, and contains no coherent peripheral weldings. Moreover, this fourteenth embodiment demonstrates a number of the features previously described with reference to FIGS. 1–19*b* of the drawing. The ice cube bag 10$^{xiii}$ is provided with line segment shaped weldings 20'", constituting partly a substantially circumferentially peripheral welding defining the compartmentalized ice cube compartment and partly in extensions constituting side weldings being connected with top weldings 21*a*' and 21*b*' composed of a number of individual parallel line segments. The actual inlet channel of the ice cube bag is designed as a single funnel, also constituted by line segment formed individual weldings, forming rectilinear weldings converging against each other and forming the above mentioned funnel and which connects the top weldings 21*a* and 21*b* constituted by line segments to side weldings 27" connecting the funnel of the inlet channel with the side weldings formed by the line segments 20'".

The interior of the ice cube bag is divided into four perpendicular compartments by means of point weldings 24' and 25', these four interior perpendicular compartments again being divided into a number of sub-compartments by means of horizontal weldings formed by point weldings 22' and 23'. The point weldings 22', 23', 24' and 25' illustrated in FIG. 20*a*, correspond to the point weldings previously described, the point weldings 22' and 24', however, preferably being designed as elongated weldings rather than circular weldings, and similarly the weldings 22', 23', 24' and 25' may be designed as massive single weldings or constitute contour weldings, the interior of which do not constitute joints of the two opposite foil layers of the ice cube bag. Like the above described ice cube bags, the interior of the ice cube bag may be designed as an ice cube bag having 16, 20 or preferably 24 compartments.

Figure 20B:
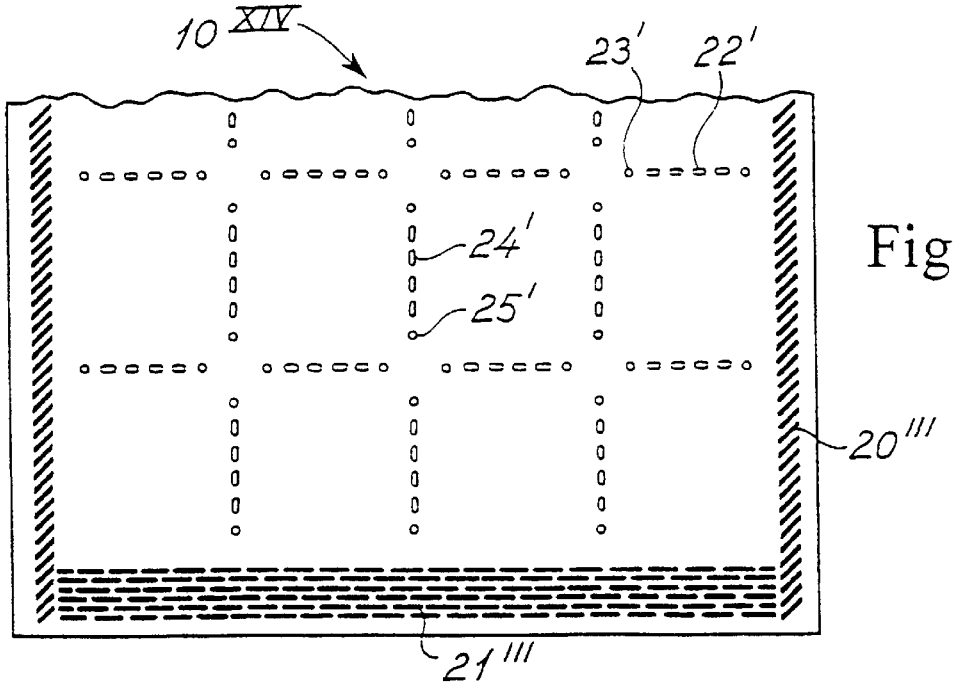

FIG. 20*b* is an illustration of an ice cube bag modified as compared to the fourteenth embodiment of the ice cube bag illustrated in FIG. 20*a*, or rather a lowermost part of this modified or fifteenth embodiment 10$^{xiv}$ of the ice cube bag according to the present invention. Similar to the fourteenth embodiment illustrated in FIG. 20*a*, the fifteenth embodiment illustrated in FIG. 20*b* is especially characterized by the peripheral weldings including the side weldings and the bottom welding being constituted by line segment formed weldings. Contrary to the fourteenth embodiment illustrated in FIG. 20*a*, in which the line segment formed weldings 20'" are all over positioned perpendicularly to the general orientation of the welding and thus radially or perpendicularly to the peripheral welding composed of the line segment formed weldings, the corresponding line segment formed weldings 20'", constituting side weldings in the fifteenth embodiment illustrated in FIG. 20*b*, are positioned in an angle i relation to the general orientation directed in accordance with the longitudinal axis of the ice cube bag. In FIG. 20*b*, these line segment formed weldings 20'" are positioned in a sloping direction in relation to the perpendicular or horizontal orientation. In addition, the fifteenth embodiment 10$^{xiv}$ illustrated in FIG. 20*b* demonstrates a bottom welding composed of a number of individual line segment formed weldings 21'", all of which are of the same extension, i.e. the same length and width, but which may alternatively be of varying length and width, these line segment formed weldings 21'" being positioned in, in total, six parallel rows, two neighbouring rows being mutually displaced by half a length of the individual line segment formed welding 21'".

Figure 20C:
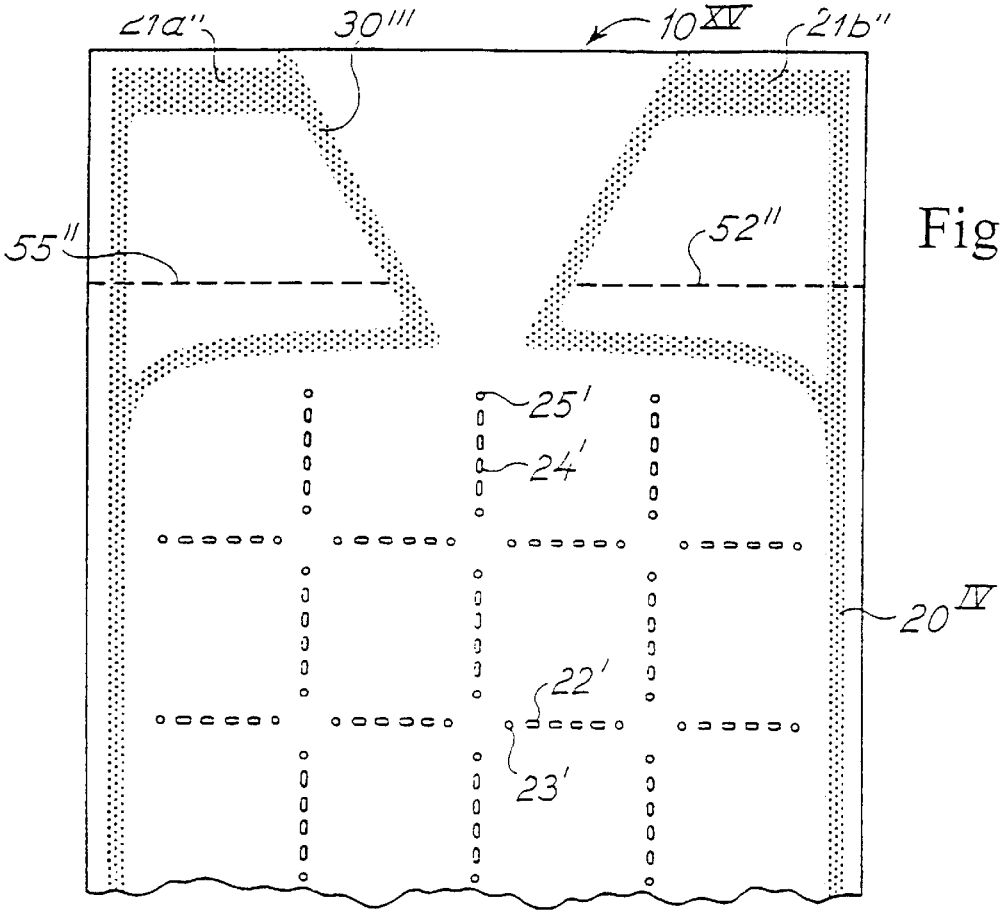

Corresponding to FIG. 20*a*, FIG. 20*c* is an illustration of a sixteenth embodiment of the ice cube bag according to the present invention, and similarly to the fourteenth embodiment illustrated in FIG. 20*a*, this sixteenth embodiment, which is designated in its entirety the reference numeral 10$^{xv}$, constitutes a so-called knot bag. In addition, the sixteenth embodiment illustrated in FIG. 20*c* differs from the fourteenth embodiment illustrated in FIG. 20*a*, by the line segment formed weldings illustrated in FIG. 20*a*, constituting the peripheral welding, the side weldings 27", the top weldings 21*a*' and 21*b*' and the inlet channel 30" being replaced by belts of smaller point weldings being positioned in a tight pattern in the form of a photographic raster pattern in which the individual point weldings are of a—compared to the compartmentalizing point weldings 22', 23', 24' and 25'—substantially smaller size or diameter, typically a size of less than 50% of the biggest dimension of these point weldings 22', 23', 24' and 25'. The individual point weldings in the photographic raster pattern forming welding constituted by the point weldings 20$^{iv}$ are positioned in a distance to the neighbouring weldings substantially corresponding to the diameter of the individual welding 20$^{iv}$. Of course, within the scope of the present invention, the embodiments illustrated with reference to FIGS. 20*a*, 20*b* and 20*c* of the drawing may be modified corresponding to the above described embodiments and, besides, per se be combined with alternative side weldings, bottom weldings and channel inlet configurations.

Figure 20D:
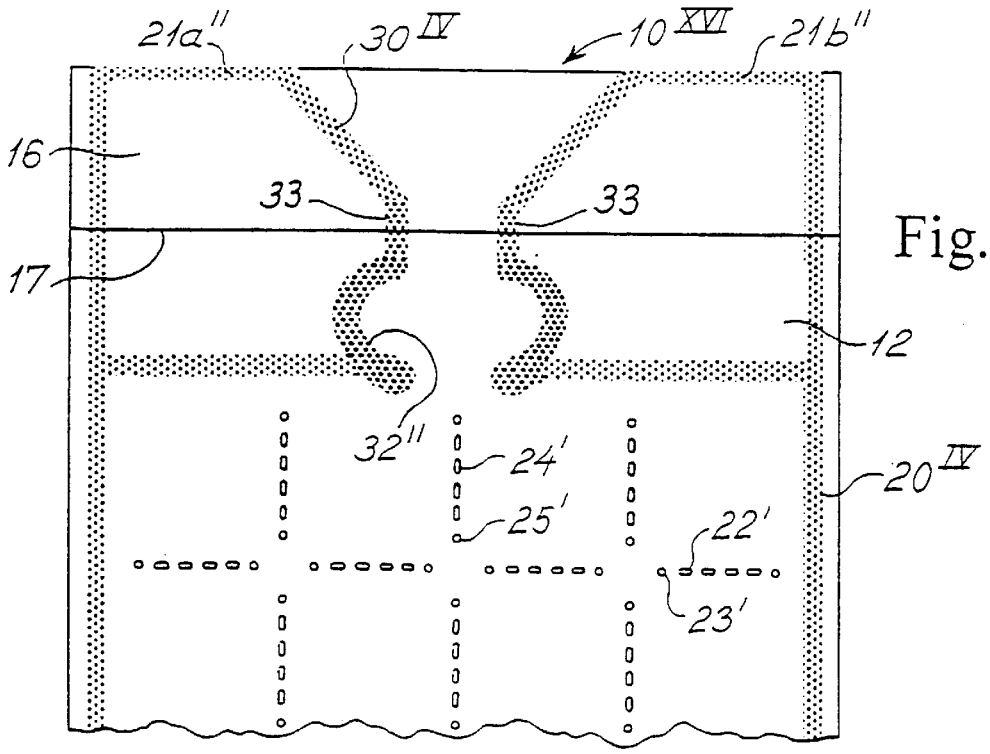

FIG. 20*d* is a schematic and plane view of a seventeenth embodiment of the ice cube bag according to the invention which ice cube bag is designated in its entirety the reference numeral 10$^{xvi}$. Similar to the above described embodiments, the ice cube bag 10$^{xvi}$ is composed of two identical plastic foils, preferably LD polyethylene foils of a thickness of 25 $\mu$m or alternatively HD-polyethylene foils of a thickness of 18 $\mu$m, one of which foils is designated the reference numeral 12. Both foils have a folded part. The folded part of the foil 12 is designated the reference numeral 16. These folded parts protrude inwardly into the interior of the ice cube bag 10$^{xvi}$ and define inner exposed edges. The foils are of substantially rectangular configuration and are in overlapping positions, the folded parts as described above protruding inwardly into the interior of the ice cube bag 10$^{xvi}$, as the foils are joined by means of a substantially circumferential joint 20$^{iv}$, two line joints extending inwardly and towards each other from the substantially circumferential joint 20$^{iv}$ positioned at an upper end of the ice cube bag 10$^{xvi}$ illustrated in FIG. 20*d* and upper line joints 21*a*" and 21*b*".

Between the line joints 21*a*" and 21*b*", an aperture is provided leading from the surroundings into the interior of the ice cube bag 10$^{xvi}$. From the above described edge, rectilinear joints 30$^{iv}$ converging against each other extend, constituting a funnel-shaped first section of the inlet channel of the ice cube bag. At the inner ends of the joints, i.e. at the constriction of the generated inlet funnel, the rectilinear joints 30$^{iv}$ converging against each other extend into two parallel rectilinear joints 33 constituting a first constriction in the inlet channel, and constitute a transition between the first section of the inlet channel of the ice cube bag mentioned above and a second section of the inlet channel of the ice cube bag which second section is defined by two oppositely positioned arcuated joints 32" connecting the above described parallel rectilinear joints 33 to the above described joints 27 constituting two joint reinforcements 33 which constitute a second constriction at the end of the inlet channel, i.e. at the transition between the inlet channel and the interior of the ice cube bag which is divided into a number of individual compartments as mentioned above. The arcuated joints 32" constitute two convex joints for generating a second section of the inlet channel which second section has—seen in the orientation perpendicular to the inlet orientation of the inlet channel—substantially larger dimensions than the first constriction generated by the two parallel rectilinear joints 33 as well as the other constriction generated by the two above mentioned joint reinforcements 33.

In the seventeenth embodiment illustrated in FIG. 20*d*, the inner exposed edges of the folded parts of the two foils extend in the entire length of the first section of the inlet channel, but not into the second section of the inlet channel, and precisely to a position opposite the two parallel rectilinear joints, vide the folded part 17 in relation to the parallel rectilinear joints 33. In accordance with the teachings of the present invention the exposed edges may be positioned in any arbitrary location along the two parallel rectilinear joints 33, i.e. in any arbitrary position within the constriction defined by the two parallel joints. Thus, the edges mentioned are positioned, seen in the entire length of the inlet channel, in the middle of the inlet channel and simultaneously positioned extending perpendicularly in the middle of the two parallel rectilinear joints 3. By means of the positioning of the folded edges in the middle of the inlet channel combined with the parallel rectilinear joints 33, an ice cube bag is obtained which provides a safe and reliable self-closing function and utilizes a minimum quantity of water for filling of the self-closure-function-providing closure pockets generated behind the folded parts, as it is also explained in EP 0 574 496, EP 0 616 948 and EP 0 825 122 to which reference is made. At the same time, unlike prior art self-closure bags, the two parallel rectilinear joints 33 constitute a tube-configurated constriction area for provision of the self-closure function which has not previously been considered possible, as the two parallel rectilinear joints 33 serve the additional purpose, besides the provision of a self-closure function generating constriction, of compensating for production variations, if any, when the folded foil parts are folded and are by means of the joints joined with the surrounding foils. For obtaining a safe self-closure function it is of decisive significance that the inner exposed edges constituting the closure pockets inside the joints 33 are positioned below the lower limitation of the funnel-shaped first section of the inlet channel, vide FIG. 20*d*, in order to ensure that the closure pockets are filled with water in a reliable manner when the ice cube bag is turned upside down after having been filled with water as it is explained in the above mentioned European patents.

In the plane illustration of FIG. 20*d*, the two foils of the ice cube bag are lying abutting each other in a plane position as confined air may be present and constitute air pockets in the interior of the ice cube bag 10. In FIG. 20*d*, the ice cube bag 10$^{xvi}$ is illustrated with its inlet aperture 26 in an upward direction which inlet aperture is to be in an upward direction when the ice cube bag is filled with liquid, especially water. At this stage it is to be noted that expressions such as "upwardly", "downwardly" etc. referring to an orientation of the ice cube bag in relation to the orientation determined by the gravitational force are to be construed as expressions solely serving the purpose of describing the normal, general orientation of the ice cube bag in use as of course a larger or smaller part of the ice cube bag may be folded in relation to the upward/downward direction, and similarly the ice cube bag 10$^{xvi}$ in its entirety may be held in a sloping position in relation to the upward/downward position.

FIG. 21 is a schematic view of a production plant for producing ice cube bags or similar welded bags in an intermittent production process. The production plant mainly corresponds to the production plant described in DK 172,066 and EP 0 795 393 and comprises a stamping and welding station 74. As will appear from the following description, dependent on the product in question, the production plant may also comprise a further stations as e.g. a foil unrolling station, a cutting and separating station and a conveyor station.

The actual production of the ice cube bags in the stamping and welding station 74 comprises a single stamping and welding operation in which the ice cube bags are produced from a two-layer foil web 76, thus producing two ice cube bags in a single stamping and welding operation. The stamping and welding operation performed in the stamping and welding station 74 is carried out discontinuously or intermittently, the foil webs being conveyed stepwise to a stamping and welding device 70, the stamping and welding operation being performed with the two two-layer foil webs being kept in a stationary position beneath the stamping and welding device 70. The stepwise conveyance of the two two-layer foil webs is achieved by means of rollers or rollers actuated by a toothed wheel and belt arrangement.

As shown in FIG. 21, the stamping and welding device 70 comprises a lower support plate 130 provided with two vertical, upwardly extending rods 132 and 134 which in turn are connected through a top bar 136 and a cross member 138 which together with the support plate 130 keep the rods 132, 134 in a vertical and mutually parallel position. The cross member 138 supports two sets of actuating cylinders 140, 142 and 144, 146 which are actuated through pressure fluid inlet hoses connected thereto and preferably are in the form of pressure air cylinders. The two sets of actuating cylinders 140, 142 and 144, 146 are designed to position the stamping and welding devices in a two-step process. In the first step the stamping and welding dies 148 and 150 comprised in the heated stamping and welding devices remain elevated in a starting position at a maximal distance above the two-layer foil webs being passed through the stamping and welding station to prevent the foil material from being melted by the heat radiating from the stamping and welding devices, and in the second step the stamping and welding dies 148 and 150 are moved from their elevated position at a certain distance above the two-layer foil web to a working position in which they are pressed down into the two-layer foil web as described below by actuating the actuating cylinders 142 and 146. Thus, the two actuating cylinders 140 and 144 are designed to position the stamping and welding dies in either the starting or working position, and by actuating the actuating cylinders 142 and 146 the stamping and welding dies are lowered towards the two-layer foil webs. The stamping and welding dies 148 and 150 are provided with lower surfaces comprising protruding, i.e. downwardly projecting prominences corresponding to the desired stampings and weldings in the ice cube bags being stamped and welded by means of the stamping and welding device 70 in the stamping and welding station.

The stamping and welding dies 148 and 150 are electrically heated and, therefore, comprise a number of electric heating units supplied by a number of connection cords, two of which are assigned the reference numerals 152 and 154, respectively. As will be obvious for the skilled person, the stamping and welding dies 148 and 150 are thermoregulated, i.e. the stamping and welding dies are kept at a well-defined temperature by means of a thermostat. The suspensions of the stamping and welding dies are cooled by water supplied and removed through cooling water inlet and outlet hoses 156 and 157, respectively. Further to the water cooling arrangement for cooling the suspension of the stamping and welding dies 148 and 150 the production plant shown in FIG. 2*a* is provided with a cooling air hose 158 mounted at and—seen in the direction of conveyance of the two-layer foil web—downstream of the complementary stamping and welding dies, the cooling air hose providing cooling air supplied from a number of air supply apertures in a air supply tube 160.

As will appear from FIG. 21, the two-layer foil web are inserted below the vertically mobile stamping and welding dies 148 and 150, which, however, are not brought in direct contact with the surfaces of the two two-layer foil webs, or two high temperature resistant heat transmission foils 162 and 164 are inserted between the upper surface of the two two-layer foil webs and the lower surface of the stamping and welding dies 148 and 150, and the lower surface of the two two-layer foils and a foil in the form of a silicone rubber sheet resiliently supported on the support plate 130, respectively, the heat transmission foils 162 and 164 forming closed, loop-shaped webs. The upper closed loop formed by the heat transmission foil 162 is provided by a total of four idler rollers 168, 170, 172 and 174, and correspondingly the closed loop formed by the high temperature resistant heat transmission foil 164 is provided by four idler rollers 176, 178, 180 and 182.

The stamping and welding station is controlled by the central control unit which is not illustrated in the figure and which furthermore controls regulators for adjusting the temperature of the heating units in the stamping and welding dies, e.g. the stamping and welding dies 148 and 150, the pressure air supply volume, etc. In the stamping and welding station, the two-layer foil web is conveyed one step, whereafter the stamping and welding dies actuated by the actuating cylinders 140 and 144 and 148 and 150 are lowered onto the two two-layer foil webs supported on the support plate 130 simultaneously with keeping the two-layer foil web in a stationary position, the two-layer foil web being pressed together between the two high temperature resistant heat transmitting foils 162 and 164. The high temperature resistant heat transmitting foils which preferably are woven teflon foils are designed to transmit heat to the upper and lower surfaces of the two two-layer foil webs during the stamping and welding process in order to provide the two two-layer foil webs with stampings and weldings corresponding to the stampings provided on the stamping dies without resulting in weak stampings and weldings and without cutting through the foils due to excessive local heating of a given area.

By pressing together the sandwich consisting of the two teflon webs 162 and 164 and the intermediary two-layer foil web, the woven teflon webs are pressed down and melted down into the melted two-layer foil webs, thus adhering the woven teflon webs 162 and 164 to the partially melted, pressed and welded two-layer foil webs. Surprisingly and importantly, due to the pressing operation adhering the woven teflon webs 162 and 164 to the stamped and welded two-layer foil webs the two-layer foil webs will not be deformed in the following step, wherein a conveyance of the two-layer foil web is provided after that the stamping and welding dies 148 and 150 are raised since by means of this stepwise conveyance, a conveyance of the welded two-layer foil web takes place a distance exactly corresponding to the width of the stamped and welded ice cube bags. Thus, FIG. 21 is a schematic view of a situation where the two-layer foil web are moving from a completed stamping and welding operation which has resulted in an ice cube bag which is not evident in the figure, and FIG. 21 shows additional ice cube bags 186 and 188 produced in the two previous stamping and welding steps.

When conveying the stamped and welded ice cube bags, e.g. the ice cube bags 186 and 188, the woven teflon webs 162 and 164 support the melted and softened foil material adhering to the surfaces of the woven teflon webs, the cooling air supplied from the air supply tube 160 cooling the heated foil webs and causing the partially melted foil material in the stampings and weldings of the ice cube bags to solidify. After release of the two-layer foil web from the stamping and welding operation the upper woven teflon web 162 is stripped from the upper surface of the welded ice cube bags, e.g. ice cube bag 186, whereas the lower woven teflon web 164 is not stripped from the welded two-layer foil webs, i.e. the completed ice cube bags, e.g. ice cube bag 188, before the implementation of a further step.

Unlike the method described in the above mentioned Danish patent No. 172,066 and correspondingly in published European patent No. 0 795 393, the embodiment of the ice cube bags 186 and 188 as ice cube bags in which not only the compartmentalized joints, but also the peripheral joints are made as point weldings allows the welded ice cube bags to be left unsupported immediately after the stamping and welding operation as due to the embodiment having point weldings not only in the compartmentalizing joints, but also in the periphery joints, an ice cube bag construction is obtained in which areas are present which are not directly melted during the stamping and welding operation and thus constitute a coherent unmelted and only partly heated two-layer foil web. Besides, the embodiment of the ice cube bags 186 and 188 with point weldings constituting the compartmentalized joints as well as the periphery joints allows the ice cube bags to be established tightly abutting on each other and thus, unlike the illustration in FIG. 21, in which the ice cube bags 186 and 188 are illustrated separately for the sake of clarity, may be positioned even directly abutting on each other or overlapping each other whereafter a periphery or edge joint of one ice cube bag, e.g. a left side edge joint of the ice cube bag 186, coincides with or is coherent with the opposite side edge joint, i.e. the right side edge joint of the ice cube bag 188.

FIG. 22 illustrates a second embodiment of the production plant for production of ice cube bags or corresponding welded bags, this plant differs from the production plant described above with reference to FIG. 21 in that the ice cube bags or similar welded bags are produced continuously in the production plant shown in FIG. 22, whereas the stamping and welding operation itself as carried out in the production plant described with reference to FIG. 21 is performed intermittently as explained above. Furthermore, the production plant shown in FIG. 22 differs from the production plant described above with reference to FIG. 21 in that the ice cube bags are produced from two separate foils 73 and 75 and not from a two-layer foil web as shown in FIG. 21. The second embodiment of the production plant according to the invention shown in FIG. 22 has been assigned the reference numeral 74' and comprises, similar to the production plant described above with reference to FIG. 21, preferably also a foil unrolling station and a cutting and separating station.

As explained above, the two-layer foil web 76' composed of the webs 73 and 75 is moved through the stamping and welding station 14' at a constant or non-varying rate and not at an intermittent rate as the production plant described above with reference to FIG. 21. Instead of a vertically movable stamping and welding device 70 the stamping and welding station 74' comprises two rotating rollers 157 and 159 which are actuated by the same motor 145 through an exchange or gear 147 and of which the roller 157 constitutes the actual stamping and welding roller, whereas the roller 159 constitutes a retaining roller. On its outer surface the welding roller 157 is provided with curved, heated stamping and welding dies. FIG. 22 shows three stamping and welding dies 167 belonging to the rotating stamping and welding roller 157. Similar to the stamping and welding dies 148 and 150 described above with reference to FIG. 21 the stamping and welding dies 167 are electrically heated and are supplied with electric force through an electric wire 153, the electric force by means of respective sliding connections 161 being transferred to heating units provided in the stamping and welding rollers 157.

Like the production plant described above with reference to FIG. 21 the stamping and welding station 74' shown in FIG. 22 is provided with woven teflon webs 162 and 164, the teflon webs forming two opposite closed loops and designed to transfer a uniform stamping and welding pressure from the rollers 157 and 159 to the two-layer foil web 76 sandwiched between the two horizontally extending teflon webs 162 and 164, but also serving the purpose of providing supporting foils which when pressing down and adhering the teflon foils to the melted areas of the stamped and welded two-layer foil web, prevent the soft, melted foil material from being stretched when the finished two-layer foil web is drawn out from the stamping and welding station 74', essentially as described above with reference to FIG. 21.

The stamping and welding of the two-layer foil webs in the continuous stamping and welding operation for the production of ice cube bags performed in the stamping and welding station 14' results in an interconnected web of ice cube bags comprising areas corresponding to individual finished ice cube bags as indicated with reference numerals 193, 195 and 197. Like in the plant 74 described above with reference to FIG. 21, the plant 74' illustrated in FIG. 22 differs from the plant described in the above mentioned Danish patent and in the above mentioned European patent application in that the upper teflon web 162 is only in contact with the two-layer foil web 76 during the stamping and welding operation proper and does not thereafter support the two-layer foil web 76' after the stamping and welding operation, as the produced ice cube bags 193, 195 and 197, like the ice cube bags 186 and 188 illustrated in FIG. 21, constitute ice cube bags in which the compartmentalizing joints as well as the periphery joints are established by point weldings which increases the mechanical strength and resistance of the immediately welded ice cube bag to prolongation or deformation due to the softened plastic material compared to a conventional ice cube bag in which the periphery weldings constitute coherent line weldings.

Figure 23:
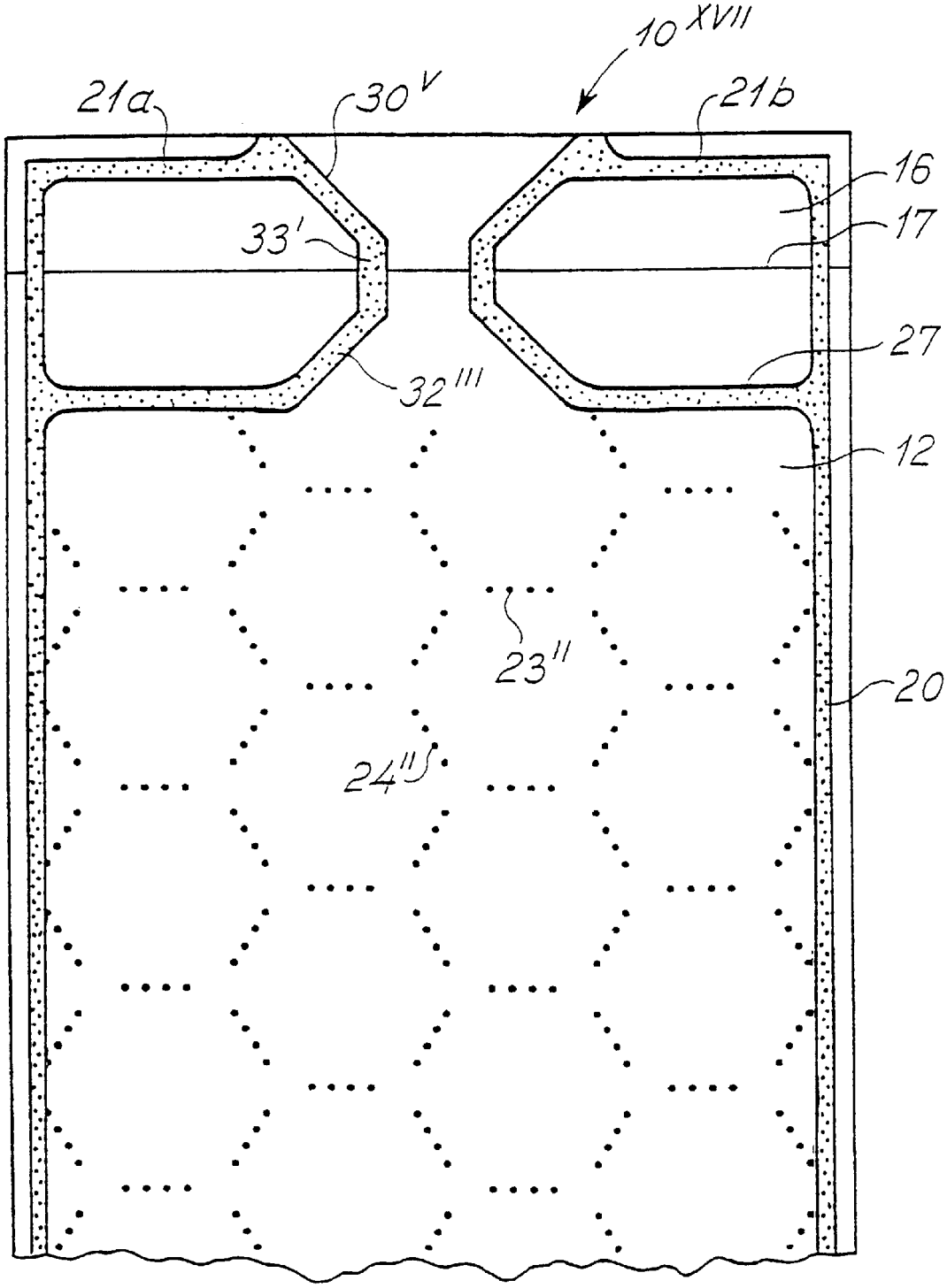
FIG. 23 is a schematic and perspective view corresponding to FIGS. 1*a*, 5, 7*a*, 8, 9, 11, 12, 13, 14, 17, 18 and 20*a*, 20*b*, 20*c* and 20*d* of an eighteenth embodiment of an ice cube bag according to the present invention.

FIG. 23 is an illustration of an eighteenth embodiment of a self-closure bag according to the present invention. This eighteenth embodiment is designated in its entirety the reference numeral $\mathbf{10}^{xvii}$ and differs from the above described seventeenth embodiment $\mathbf{10}^{xvi}$ illustrated in FIG. 20*d* in that the joints 32''' defining the second section of the inlet channel are constituted by two rectilinear joints diverging from the two parallel, rectilinear joints 33' which in relation to the folded edge 17 are reversed symmetrical in relation to the joints $\mathbf{30}^{v}$ which corresponding to the joints $\mathbf{30}^{iv}$ illustrated in FIG. 20*d* constitute a funnel-shaped first section of the inlet channel. The inlet channel constituted by the joints $\mathbf{30}^{v}$, 33' and 32''' in the embodiment illustrated in FIG. 23 provides a figure which is reversed symmetrical in relation to the longitudinal axis as well as the median line of the inlet channel corresponding to the folded edge 17.

It should be noted that the eighteenth embodiment illustrated in FIG. 23 differs from the seventeenth embodiment illustrated in FIG. 20*d* in that the weldings 20, 21*a*, 21*b*, $\mathbf{30}^{v}$, 31' and 32''' all constitute coherent line weldings unlike the peripheral weldings illustrated in FIG. 20*d* constituted by individual points. Moreover, the ice cube bag $\mathbf{10}^{xvii}$ differs from the embodiments illustrated in FIGS. 1–20*d* of the drawing in that the compartmentalizing point weldings constitute hexagonal ice cube compartments positioned in a honeycomb configuration unlike the square ice cube compartments of the previously described embodiments. The hexagonal ice cube compartments illustrated in FIG. 23 are defined by a number of point weldings 23" and 24" where each side edge of the hexagonal ice cube compartments is defined by four individual point weldings.

Even though the above described ice cube bags are preferably intended for freezing of water for provision of ice lumps or ice cubes, the ice cube bags per se, or a modified embodiment of the ice cube bags, may be used for freezing of other materials such as foodstuffs or provisions to be frozen in small individual portions.

Preferably, the above described ice cube bags are produced in the industry by utilizing continuous or intermittent welding techniques which are described in Danish patent No. 172,066 or correspondingly in published European patent application No. 0 795 393 to which reference is made, these two publications hereby being considered incorporated in the present specification by reference.

EXAMPLE

A prototype of the presently preferred embodiment of the ice cube bag according to the invention illustrated in FIGS. 1*a*, 1*b* and 2 was produced from to foils of LD-polyethylene of a thickness of 25 $\mu$m. Each of the LD-polyethylene foils 12 and 14 of a thickness of 25 $\mu$m had a width of 18 cm and a total length of 38.5 cm, each of the folded parts 16 and 18 constituting a fold of a piece of 4.5 cm of each of the foil layers 12 and 14 of totally 38.5 cm. Thus the total length of the ice cube bag was 34 cm. Each of the ice cube compartments, in total 24 ice cube compartments, had a width of 4.5 cm and a length of 4.8 cm. The compartmentalizing point weldings 22 and 24 were circular point weldings of a diameter of 0.9 mm, whereas the point weldings 23 and 25, also constituting circular point weldings, had a diameter of 1.1 mm.

When testing this prototype of the presently preferred embodiment of the ice cube bag according to the invention it turned out that the ice cube bag functioned correctly when utilized in accordance with the intended appliance.

These tests showed that by means of the prototype of the ice cube bag implemented in accordance with the teachings of the present invention the desired tearing apart function and furthermore the intended conversion from a compartmentalized into a non-compartmentalized ice cube bag were obtained.

During further tests performed in a laboratory on the other of the above described embodiments corresponding excellent results were obtained in relation to the tearing apart function and possibility of converting the ice cube bag from a compartmentalized in a non-compartmentalized bag. Especially, these tests demonstrated that ice cube bags produced with six horizontal and perpendicular point weldings corresponding to the third embodiment of the ice cube bag according to the present invention illustrated in FIG. 7*a* was able to resist a pressure of 0.9 m water column pressure, whereas an ice cube bag, in other respects identical with the embodiment illustrated in FIG. 7*a* and with eight perpendicular and horizontal point weldings in each set was able to resist an inner pressure of 1.3 m water column pressure. On the other hand, an ice cube bag having five or seven point weldings in each set, was unable to resist such pressures. The inventor construes this a proof that the distension of the foil in the centre of the individual set of horizontal and perpendicular point weldings during filling of the ice cube bag produces a maximum pull precisely in this centre of the imaginary separation line between the ice cubes, and therefore an odd number of point weldings in the sets of horizontal and perpendicular point weldings provide/s that the middlemost of the point weldings in the individual set of point weldings is exposed to this maximum force influence or this maximum pull which is not the case when the number of point weldings in the sets of horizontal and perpendicular is even and thus the aforementioned force concentration or the aforementioned maximum pull is thus distributed on two point weldings instead of on a single point welding like in the case of an odd number of point weldings.

Even though the above invention has been described with reference to a number of preferred embodiments it will be evident for people skilled in the art that numerous modifications and amendments may be made within the scope of the invention without deviating from the spirit and scope of the invention as defined in the following patent claims.

Especially, it should be noted that the above described embodiments may be combined in such a manner that features of a described embodiment may be combined in another specific described embodiment and likewise the compartmentalized embodiments described in connection with a number of various self-closure ice cube bags may correspondingly be used in non-self-closure ice cube bags, e.g. knot bags of the type generally described in the above mentioned US patent. Similarly, the principles of the invention are not limited neither to self-closure bags nor to knot closure bags, but may also be utilized in connection with other ice cube bags having another type of closure.

It should be noted that the present invention is not limited to welding of plastic foils, but that the embodiment of tearing-apart-joints characteristic of the present invention may be established by means of glueing of plastic foils. Independent on utilization of glueing or welding of foils, it has turned out that, compared to conventional ice cube bags in which coherent separation weldings are used between the individual ice cube compartments, the embodiment of the compartmentalizing weldings as point weldings characteristic of the present invention provides a substantially better utilization of the materials, measured in the form of a bigger net volume of the ice cubes produced from a specific ice cube bag area construed as the area defined by the outer contour of the ice cube bag. Due to the precise embodiment of the final product, the application of glueing or welding as alternative production techniques furthermore enables a positioning of the individual ice cube bags during the production process tightly abutting on each other and thus a better utilization of the used quantity of raw materials, compared to conventional production techniques. Besides, in the individual ice cube bags, instructions for tearing apart the bag may be provided by glueing or welding as explained above with reference to FIG. 9, 10, 12 and 13 of the drawing, as, additionally, by means of the used glue application technique or the used welding technique, instructions may be established in the foil material in the form of a direction or an instruction for the intended application of the ice cube bag.

Furthermore, it should be noted that the present invention is not limited to the above mentioned types of foils, LDPE and HDPE, or the above stated foil thicknesses as in accordance with the teachings of the present invention arbitrary polymer or foil of a plastics material of glueable or weldable thickness of e.g. thicknesses smaller than the above mentioned 18 $\mu$m, e.g. down to 12 $\mu$m or smaller, may be used, and similarly in an ice cube bag to foils of the same or of different type and/or to foils of the same or different thickness may be used. Co-extruded and laminated foils may furthermore be utilized in connection with the ice cube bags according to the present invention.

What is claimed is:

1. An ice cube bag comprising:

two sheet-shaped foil layers having substantially identical geometrical configurations and defining an outer periphery;

a peripheral joint extending along the major part of said outer periphery of said foil layers with the exception of a peripheral area constituting an inlet aperture of said bag, which peripheral joint joins said foil layers together mainly overlapping each other and defining an inner chamber in the interior of said bag which inner chamber is divided into several ice cube compartments being defined in relation to each other by separate joints of said foil layers; and an inlet channel defined by joints of said foil layers and extending from said inlet aperture to said inner chamber of said bag, thereby allowing admission from the surroundings to said inner chamber of said bag through said inlet channel;

wherein each of said separate joints defining two neighboring ice cube compartments in relation to each other is constituted by a number of individual joints, and wherein each of said individual joints establishes a connection between said two sheet-shaped foil layers with such a joint strength and with such a limited area extension that said individual joint is not broken when said foil layers are exposed to a separation force, but provides a tearing apart or perforation in one of said foil layers along the periphery of said individual joints.

2. The ice cube bag according to claim 1, wherein said individual joints are positioned in such mutual distance that when one of said foil layers is torn apart or perforated, said individual joints provide directions for a perforation line in one of said foil layers.

3. The ice cube bag according to claim 1, wherein the factor calculated as the area of one of said individual joints expressed in square millimeters divided by the circumference or perimeter of the same joint measured in millimeters of the same joint lies within the range of about 0.025 mm to about 0.5 mm.

4. The ice cube bag according to claim 2, wherein the factor calculated as the area of one of said individual joints expressed in square millimeters divided by the circumference or perimeter of the same joint measured in millimeters of the same joint lies within the range of about 0.025 mm to about 0.5 mm.

5. The ice cube bag according to claim 1, wherein each of said individual joints has an area corresponding to the area of a circle having a diameter of between 0.1 mm and 5 mm.

6. The ice cube bag according to claim 1, wherein said peripheral joint, said inlet channel defining joints and said individual joints are formed by a method selected from the group consisting of glueing and molding.

7. The ice cube bag according to claim 2, wherein said peripheral joint, said inlet channel defining joints and said individual joints are formed by a method selected from the group consisting of glueing and molding.

8. The ice cube bag according to claim 1, wherein said individual joints have a configuration selected from the group consisting of circles, ellipses, line-segments, triangles, rectangles, squares, polygons and arbitrary convex or concave contours.

9. The ice cube bag according to claim 1, wherein said ice cube bag is a self-closure bag in which said two sheet-shaped foil layers provide prolongations constituting two closure valve flaps positioned at said inlet channel and extending from the inlet channel and into the interior of said bag toward said inner chamber of said bag along said inlet channel, and which are joined through said inlet channel defining joints so as to provide two closure pockets being open toward said inner chamber of said bag.

10. The ice cube bag according to claim 1, wherein said ice cube bag comprises a bag having a knot closure, said two sheet-shaped foil layers outside said inlet channel defining joints being provided with perforations or cuttings for allowing tying of the foil material of the two sides of said inlet channel for provision of a closure knot closing said inlet channel.

11. The ice cube bag according to claim 1, wherein said sheet-shaped foil sheets of said ice cube bag are produced from a material selected from the group consisting of LDPE, HDPE, plastic foil material, polymer foil material, aluminum foil material, and combinations of plastic, polymer and aluminum foil materials.

12. The ice cube bag according to claim 1, wherein the number of ice cube compartments in said inner chamber of said ice cube bag is greater than 2.

13. The ice cube bag according to claim 12, wherein said ice cube compartments in said inner chamber of said ice cube bag are grouped into separate subchambers.

14. The ice cube bag according to claim 1, wherein said two sheet-shaped foil layers are substantially rectangular.

15. The ice cube bag according to claim 1, wherein a connection from said inner chamber of said ice cube bag is provided to expansion chambers positioned on at least one side of said inlet channel.

16. The ice cube bag according to claim 1, wherein tearing perforations outside said inlet channel in said two sheet-shaped foil layers are provided for directing the tearing apart of said ice cube bag.

17. A freezing mold bag comprising:

two sheet-shaped foil layers having substantially identical geometrical configurations and defining an outer periphery;

a peripheral joint extending along a major part of said outer periphery of said foil layers with the exception of a peripheral area constituting an inlet aperture of said bag, which peripheral joint joins said foil layers together mainly overlapping each other and defining an inner chamber in the interior of said bag by separate joints of said foil layers; and an inlet channel defined by joints of said foil layers and extending from said inlet aperture to said inner chamber of said bag, thereby allowing admission from the surroundings to said inner chamber of said bag through said inlet channel;

wherein said peripheral joint comprises a number of individual joints establishing a connection between said two sheet-shaped foil layers with such a joint strength and with such a limited area extension that said individual joint is not broken when said foil layers are exposed to a separation force, but provides a tearing apart or perforation in one of said foil layers along the periphery of said individual joints.

18. The freezing mold bag according to claim 17, wherein said individual joints are positioned in such mutual distance that when one of said foil layers is ton apart or perforated, said individual joints provide directions for a perforation line in one of said foil layers.

19. The freezing mold bag according to claim 17, wherein the factor calculated as the area of one of said individual joints expressed in square millimeters divided by the circumference or perimeter of the same joint measured in millimeters lies within the range of 0.025 mm to 0.5 mm.

20. The freezing mold bag according to claim 18, wherein the factor calculated as the area of one of said individual joints expressed in square millimeters divided by the circumference or perimeter of the same joint measured in millimeters lies within the range of 0.025 mm to 0.5 mm.

21. The freezing mold bag according to claim 17, wherein each of said individual joints has an area extension corresponding to the area of a circle having a diameter of between 0.1 mm and 5 mm.

22. The freezing mold bag according to claim 18, wherein each of said individual joints has an area extension corresponding to the area of a circle having a diameter of between 0.1 mm and 5 mm.

23. The freezing mold bag according to claim 19, wherein each of said individual joints has an area extension corresponding to the area of a circle having a diameter of between 0.1 mm and 5 mm.

24. The freezing mold bag according to claim 20, wherein each of said individual joints has an area extension corresponding to the area of a circle having a diameter of between 0.1 mm and 5 mm.

25. The freezing mold bag according to claim 17, wherein said inlet channel defines joints, and said joints are made by a method selected from the group consisting of glueing and welding.

26. The freezing mold bag according to claim 17, wherein said individual joints have a configuration selected from the group consisting of circles, ellipses, line segments, triangles, rectangles, square, polygons, and arbitrary convex or concave contours.

27. The freezing mold bag according to claim 17, wherein said sheet-shaped foil sheets of said freezing mold bag are produced from a material selected from the group consisting of LDPE, HDPE, plastic foil material, polymer foil material, aluminum foil material, and combinations of plastic, polymer, and foil materials.

* * * * *

UNITED STATES PATENT AND TRADEMARK OFFICE

CERTIFICATE OF CORRECTION

PATENT NO. : 6,322,044 B1
DATED : November 27, 2001
INVENTOR(S) : Vandegal-Nielsen It is certified that error appears in the above-identified patent and that said Letters Patent is hereby corrected as shown below:

Title page,
FOREIGN PATENT DOCUMENTS, insert:
-- 0335270 10/1989 (EP)
2623005 12/1977 (DE)
0460518 12/1991 (EP)
2266267 10/1993 (GB) --.

Column 16,
Line 55, "4º C." should be -- 4º C --.

Column 27,
Line 10, "$10x^{iii}$" should be -- $10^{xiii}$ --.

Column 38,
Line 18, "ton" should be -- torn --.

Signed and Sealed this

Third Day of September, 2002

*Attest:*

*Attesting Officer*

JAMES E. ROGAN
*Director of the United States Patent and Trademark Office*